US011512505B2

(12) United States Patent
Schwickerath et al.

(10) Patent No.: US 11,512,505 B2
(45) Date of Patent: Nov. 29, 2022

(54) MOTORIZED MOVABLE STRIKE FOR A VEHICLE DOOR

(71) Applicant: TriMark Corporation, New Hampton, IA (US)

(72) Inventors: Tobias J. Schwickerath, New Hampton, IA (US); Matthew L. Hidding, Elma, IA (US); Michael P. Gruber, New Hampton, IA (US)

(73) Assignee: TriMark Corporation, New Hampton, IA (US)

( * ) Notice: Subject to any disclaimer, the term of this patent is extended or adjusted under 35 U.S.C. 154(b) by 1431 days.

(21) Appl. No.: 15/476,320

(22) Filed: Mar. 31, 2017

(65) Prior Publication Data

US 2017/0284134 A1 Oct. 5, 2017

Related U.S. Application Data

(60) Provisional application No. 62/316,273, filed on Mar. 31, 2016.

(51) Int. Cl.
*E05B 81/22* (2014.01)
*E05B 81/06* (2014.01)
(Continued)

(52) U.S. Cl.
CPC ..... *E05B 81/22* (2013.01); *E05B 81/06* (2013.01); *E05B 81/21* (2013.01); *E05B 81/66* (2013.01); *E05B 81/74* (2013.01); *E05B 81/80* (2013.01); *Y10S 292/23* (2013.01); *Y10T 292/0908* (2015.04); *Y10T 292/1082* (2015.04); *Y10T 292/1092* (2015.04); *Y10T 292/696* (2015.04); *Y10T 292/702* (2015.04); *Y10T 292/705* (2015.04); *Y10T 292/707* (2015.04)

(58) Field of Classification Search
CPC ..... E05B 81/22; E05B 81/06; E05B 81/21; E05B 81/66; E05B 81/74; E05B 81/80; Y10T 292/0908; Y10T 292/108; Y10T 292/1082; Y10T 292/1092; Y10T 292/11; Y10T 292/696; Y10T 292/702; Y10T 292/705; Y10T 292/707; Y10S 292/23
See application file for complete search history.

(56) References Cited

U.S. PATENT DOCUMENTS 1,614,046 A * 1/1927 Schmidgall ..... E05B 15/0245 292/341.18
3,403,934 A * 10/1968 Butts ..... E05B 81/10 292/341.16

(Continued)

*Primary Examiner* — Christine M Mills
*Assistant Examiner* — Faria F Ahmad
(74) *Attorney, Agent, or Firm* — McKee, Voorhees & Sease, PLC

(57) ABSTRACT

A motorized moveable strike assembly is provided for a vehicle door. The assembly includes a strike on the door post which is moveable by an electric motor between extended and retracted positions. A latch on the door releasably engages the strike. A switch in the latch sends a signal to the controller to actuate the motor after the latch is engaged so as to retract the strike from the extended position to fully close the door. When the latch is disengaged from the strike, the latch switch sends a signal to controller to actuate the motor so as to extend the strike from the retracted position to the extended position as to prepare for the next door closing.

8 Claims, 37 Drawing Sheets

(51) Int. Cl.

| | |
|---|---|
| ***E05B 81/80*** | (2014.01) |
| ***E05B 81/66*** | (2014.01) |
| ***E05B 81/20*** | (2014.01) |
| ***E05B 81/74*** | (2014.01) |

(56) References Cited

U.S. PATENT DOCUMENTS 4,035,093 A * 7/1977 Redshaw ..... F16B 5/0225 403/4
4,585,981 A 4/1986 Zintler
4,707,007 A * 11/1987 Inoh ..... E05B 81/34 292/216
4,709,196 A 11/1987 Mizuta
4,746,845 A 5/1988 Mizuta et al.
4,796,932 A 1/1989 Tame
5,066,056 A 11/1991 Schap
RE33,758 E * 12/1991 Compeau ..... E05B 81/22 292/216
5,127,947 A 7/1992 Takimoto et al.
5,193,868 A * 3/1993 O'Toole ..... F16B 37/044 292/341.15
5,746,459 A 5/1998 Giroux, Jr. et al.
5,755,468 A 5/1998 Buchanan, Jr.
5,765,886 A 6/1998 Buchanan, Jr.
5,872,436 A 2/1999 Bergmann et al.
5,938,254 A 8/1999 Weyerstall
5,994,858 A 11/1999 Miura
5,997,054 A * 12/1999 Baudu ..... F02K 1/76 292/201
6,167,770 B1 1/2001 Nass
6,274,947 B1 8/2001 Terashima
6,366,042 B1 4/2002 Gerbetz
6,382,690 B1 * 5/2002 Dessenberger, Jr. ... E05B 41/00 292/113
6,540,270 B1 4/2003 Reddmann
6,548,974 B2 4/2003 da Silva Filgueiras
6,580,242 B2 6/2003 Hirose et al.
6,581,990 B1 6/2003 Menke et al.
6,666,487 B2 12/2003 Oxley et al.
6,715,808 B2 4/2004 Oxley et al.
6,814,401 B2 * 11/2004 Takada ..... E05B 85/045 292/341.18
6,867,563 B2 3/2005 Ohshima
7,014,228 B2 3/2006 Hirai
7,015,666 B2 3/2006 Staus
7,170,244 B2 1/2007 Choby
7,250,737 B2 7/2007 Takahashi
7,275,774 B2 10/2007 Oberheide
7,307,393 B2 12/2007 Bizard
7,309,971 B2 12/2007 Honma et al.
7,341,292 B2 3/2008 Brose et al.
7,360,635 B2 4/2008 Rhodes et al.
7,367,598 B2 5/2008 Arabia, Jr. et al.
7,402,971 B2 7/2008 Averitt
7,445,258 B2 11/2008 Rice et al.
7,489,095 B2 2/2009 Pebre
7,568,745 B2 8/2009 Brose et al.
7,569,999 B2 8/2009 Hayashi
7,576,502 B2 8/2009 Pedemas et al.
7,646,158 B2 1/2010 Suzuki et al.
7,654,039 B2 2/2010 Heyn et al.
7,690,152 B2 4/2010 Kobayashi et al.
7,808,197 B2 10/2010 Kimura et al.
7,859,204 B2 12/2010 Sakai et al.
7,960,932 B2 6/2011 Ludwig et al.
7,977,902 B2 7/2011 Batejat et al.
8,104,824 B2 1/2012 Hitomi
8,370,029 B2 2/2013 Egger et al.
8,541,969 B2 9/2013 Holzinger et al.
9,004,570 B1 * 4/2015 Krishnan ..... E05B 63/0056 292/201
9,068,816 B2 6/2015 Grills et al.
9,140,039 B1 * 9/2015 Krishnan ..... E05B 85/045
9,644,404 B2 * 5/2017 Strole ..... E05B 85/045
9,951,547 B2 * 4/2018 Puscas ..... E05B 63/0056
2005/0218670 A1 * 10/2005 Brose ..... E05B 81/22 292/341.16
2006/0175845 A1 * 8/2006 Arabia, Jr. ..... E05B 81/22 292/341.16
2006/0175846 A1 * 8/2006 Rice ..... E05B 81/22 292/341.16
2010/0090480 A1 * 4/2010 Pyun ..... E05B 81/22 292/341.15
2010/0314890 A1 12/2010 Hemingway et al.
2012/0067895 A1 * 3/2012 Williams ..... B65D 43/22 220/324
2013/0020919 A1 * 1/2013 Rechberg ..... E05B 15/025 312/333
2014/0353989 A1 * 12/2014 Nelson ..... E05B 15/0245 292/341.18
2016/0090762 A1 3/2016 Strole et al.
2017/0302067 A1 10/2017 Bochen

* cited by examiner

MOTORIZED MOVABLE STRIKE FOR A VEHICLE DOOR

CROSS-REFERENCE TO RELATED APPLICATIONS

This application claims priority to previously filed provisional application, U.S. Ser. No. 62/316,273, filed Mar. 31, 2016, which is herein incorporated by reference in its entirety.

BACKGROUND OF THE INVENTION

Generally power door latch systems are known within the automotive and other vehicular field and are used to overcome the high force requirements to move doors and trunks into the fully closed position. Applications range from personnel doors, trunk lids, lift gates and sliding doors on mini-vans. There generally are two types of powered door closure devices; a cinching latch where a rotary latch with a claw or rotor is driven to rotate by a motor and cinch the strike approximately 6-8 millimeters and a powered strike where the striker is motorized to engage with the rotary latch and pull the door into the fully closed position. Typically, power cinching latches are used on personnel doors including mini-van sliding doors and rear lift gates on SUV's and mini-vans and power cinching strikes, which are used on trunk lids.

Typically, a power cinching strike is activated when the rotary latch is fully engaged with the strike (primary and fully latched position); a sensor on the latch signals the door cinch mechanism to pull the door into the door closed position.

One problem with prior art cinching latches is the lack of an override system to open the door in the event that there is a power failure to the motor. If the door is closed and power to the motor is cut off, for example if the vehicle battery is dead, the door cannot be opened. Such a lockout condition is undesirable if ingress or egress is needed potentially causing an unsafe condition.

One problem with prior art powered strikes is the lack of any adjustment of the strike. Therefore, any variances in manufacturing due to acceptable tolerances reduces or minimizes the effectiveness of the powered strike.

Another deficiency of the prior art powered strikes is the relatively short travel that is commercially available, typically 6-8 millimeters (0.24-0.31 inch). This distance is not enough to allow large doors to engage the strike without starting to compress the door seals.

The present invention relates to a power strike for hinged and sliding personnel doors for vehicular applications. There are several types/styles of power strikes: Eccentric cam, linear drive—acme thread, linear drive—rack and pinion, toggle action, cam and offset lever, and combinations of the above.

The need for such a door latch system is becoming known in the agricultural and construction industries. In tractors and cabs of duty equipment as the size of the doors, door seals and compression of air inside the cabs are making it difficult to close the door without excessive force and speed. For example, the doors of the tractor and big equipment are becoming larger, and constructed with more glass for increased visibility. Thus, the doors have a large perimeter, while the volume of the cab is relatively small, for one or two people. As the door closes, the air in the cab compresses, thereby increasing internal air pressure. Similarly, the large door size necessitates larger seals with more surface area, which also increases the force required to close and seal the door in the door frame.

Accordingly, a primary objective of the present invention is the provision of a motorized strike for use in large vehicle doors, particularly in the agriculture and construction industries.

A further objective of the present invention is the provision of a personnel door on large vehicles having an improved door latch system with a motorized strike to simplify closing of the door.

A further objective of the present invention is the provision of a powered strike on a door latch assembly with the ability to adjust the position of the strike on the door frame so as to fine tune the closing movement of the door, as well as provide for assembly and manufacturing tolerances of the doors and cabin.

Still another objective of the present invention is the provision of a powered door strike which maintains the normal operation of the latch even in the absence of electric power to the strike, so that an operator can always open the door from inside and outside the vehicle.

Another objective of the present invention is the provision of a powered door strike having a safety feature which includes a person from getting locked in or getting locked out of the vehicle.

Another objective of the present invention is the provision of a motorized movable strike for a vehicle door which is economical to manufacture, easy to install, efficient, effective, and safe in operation.

These and other objectives become apparent from the following description of the invention.

SUMMARY OF THE INVENTION

A motorized moveable strike is mounted to a door post where a fixed strike would normally be mounted and provides prescribed linear movement of the strike. This movement provides extension of the door edge more specifically near the latch when the latch is engaged, such that the door can be easily shut on the strike with minimal effort and then drawn to a normally closed position where the door is compressed into the door seal fully sealing the door. In the current design, the strike moves approximately 1" between an extended position to a retracted position, but it is recognized that this dimension could be reduced or extended depending on the final application, design of the door and seals. Once the door is fully latched onto the extended strike, a switch in the rotary latch tells the control system that the latch is in place, and then the strike control system detects that the latch is in place and begins to move the strike to its retracted and sealed position. As this happens the door is drawn into its normally closed position which engages the seal with the frame and the door becomes sealed as it moves to its normally closed position. Upon releasing the latch through a releasing mechanism, the switch in the rotary latch tells the controller that the latch has been removed from the strike, and then the strike control system detects that the latch has been removed from the strike and the control extends the strike to approximately 1" outward of the retracted position. This prescribed outboard movement moves the strike into extended position which allows for the next latching event. This motorized moveable strike system will lessen the events where a door is only partially engaged because it offers a closing event that is not impeded by door seal or air compression. This is accomplished as the door engages the door seal as the strike moves to the retracted closed position after the latch has been engaged with the strike.

The motorized movable or cinching strike for vehicle doors, according to the present invention has numerous beneficial features, including but not limited to the following.

The motorized moveable strike is mounted to a door post where a rotary latch strike would normally be mounted and provides prescribed linear movement of the strike. This movement provides movement of the door edge near the latch when the latch is engaged, such that the door can be easily shut on the strike with minimal effort and then drawn to a position where the seal load is increased to seal the door. This motorized moveable strike system will lessen the events where a door is only partially engaged because it offers a closing event that is not impeded by seal or air compression, as the strike engages the door seal by moving the door to a retracted position The strike moves from its retracted position to an extended position approximately 1" outboard of the vehicle centerline. Once the door is latched onto the strike, the strike control system verifies that the latch is in the primary latching position and begins to move the strike to its intended retracted position. As this happens the door is drawn into its normal closed position, and the seal is engaged with the frame and the door becomes sealed.

Upon releasing the latch, the strike control system senses that the latch has been removed from the strike and the control again moves the strike to approximately 1" outward of the retracted position for the next latching event.

In order to be able to facilitate adjustment, an adjustable link is in place to link the motor to the moveable strike carrier. This will allow for inboard and outboard adjustment of the strike in both the extended and retracted positions.

When the strike is at is most inboard and outboard positions, the pivot rivet, torque wheel drive pin, and motor drive shaft are directly in line. This allows for the mechanism to be very strong in the fact that any inboard or outboard forces on the mechanism do not translate into rotational energy for the motor to resist.

The whole mechanism is scalable and can be scaled up and down for larger and smaller size doors. This allows for this technology to cross several types of doors from compartment to occupant.

The power for the strike is independent from any latching device, and should there be a power failure the door would still be operable and able to be latched or unlatched, no matter the state of the strike. This independence accommodates concerns over a mechanism failing in the closed and retracted position and keeping an occupant from egressing a vehicle as well as always being able to have the door secured onto the strike.

The powered strike allows latches to be kept simple and allows adjustment of the mounting fasteners based on the strike mount to facilitate tolerance adjustment or control the amount to door seal compression. Thus, the powered strike is more simply able to retrofit to existing applications, by just adjusting the mounting plate for the cinching strike.

The integration of the mechanical and electromechanical systems into the latch and the motorized movable strike, allows the strike to know the status of the door latch at all times.

The integration of an external switch into the latch senses the door being fully latched in the primary position on the strike, and signals the controller to actuate and retract the strike. Conversely the same latch switch can tell the controller if the latch is disengaged and to extend the strike.

Safety is considered by using switch/bump strips at the door edge, which can be integrated into the controller to reverse the power and move the strike back to an extended direction to remove an obstruction.

Safety reversing can also be done in different fashions. For example, a stepper style motor has a known signal wave, and compares a closing event to the normal signal, and compare these waves, with any deviation signaling an obstruction to the controller and reverse the compression to extend the strike again. Another method is to establish a high amperage level that can be detected by the controller that is caused from an obstruction around the door perimeter, that would stop and reverse the motor, thereby extending the strike.

This powered strike assembly is attached to the door post, which keeps the assembly in an area that is not obstructing a critical line of sight. The strike takes up space that is already taken up by the cab rollover protection system (ROPS), and eliminates having to take up additional area on the door glass for the latch. Since the moveable parts are built into the powered strike assembly, which is mounted to the ROPS, additional latch parts which take up additional space into the latch are eliminated. Thus this strike mechanism adds function to a cab without detracting from valuable visibility for the operator.

The cinching strike mechanism carries provisions for strength in all the normal FMVSS loading orientations. By capturing a pair of rivets in slots, FMVSS 206 safety standard static loading is achieved with this moveable mechanism. These rivets and slots achieve both longitudinal and transverse loading goals as set by FMVSS 206 safety standards.

The design and flexibility of this moveable strike mechanism also allows for future expansion of function, such as the flexibility to add a gear box to the back of the mechanism which would allow remote drive of the strike mechanism by a cable or rod drive. This allows for remote location of the drive motor to eliminate packaging concerns near the strike position on the roll over protection structure (ROPS).

Utilizing a gear box drive adds the ability of this strike mechanism to be driven remotely, which in turn allows use of one drive motor with two output points to drive two cinching strike mechanisms. This would allow placement of two movable strike mechanisms on larger doors where the mechanisms are driven by one drive motor and they are located at the top and bottom of a larger area door to draw multiple points of the door closed.

Utilizing a moveable pivoting cinching mechanism means that this does not have to be limited to moving a strike. With the moveable plate cinching technology, the moveable plate can be placed on the door glass or door frame and the latch can be placed on the moveable plate. This would allow all power mechanisms in the door so that power/wire routing all has to be in one area, and then the moveable mechanism can cinch the door by moving the latch on the door glass instead of moving the strike itself. This could be a cost competitive option due to power/wire routing and going back to a simple strike on the ROPS post.

Motor selection and torque wheel sizing can drive many aspects regarding performance of the cinching mechanism. For example, the torque wheel pivot to pin distance can change the overall cinch distance regarding the known 1" pull travel requirement. The other factor is the RPM of the motor and the speed at which the mechanism pulls the cinch distance and the time in which it travels this distance. These two factors linked together control the amount of force output. It is noted that speed, distance, and time are all interrelated and affect each other in the performance of the power strike mechanism. Common commodity motors can have a certain RPM output and given output torque, such that the torque wheel design can then be designed such that the outputs of the cinch mechanism meet customer requirement based on a specific motor output.

DETAILED DESCRIPTION OF THE INVENTION

Figure 1:
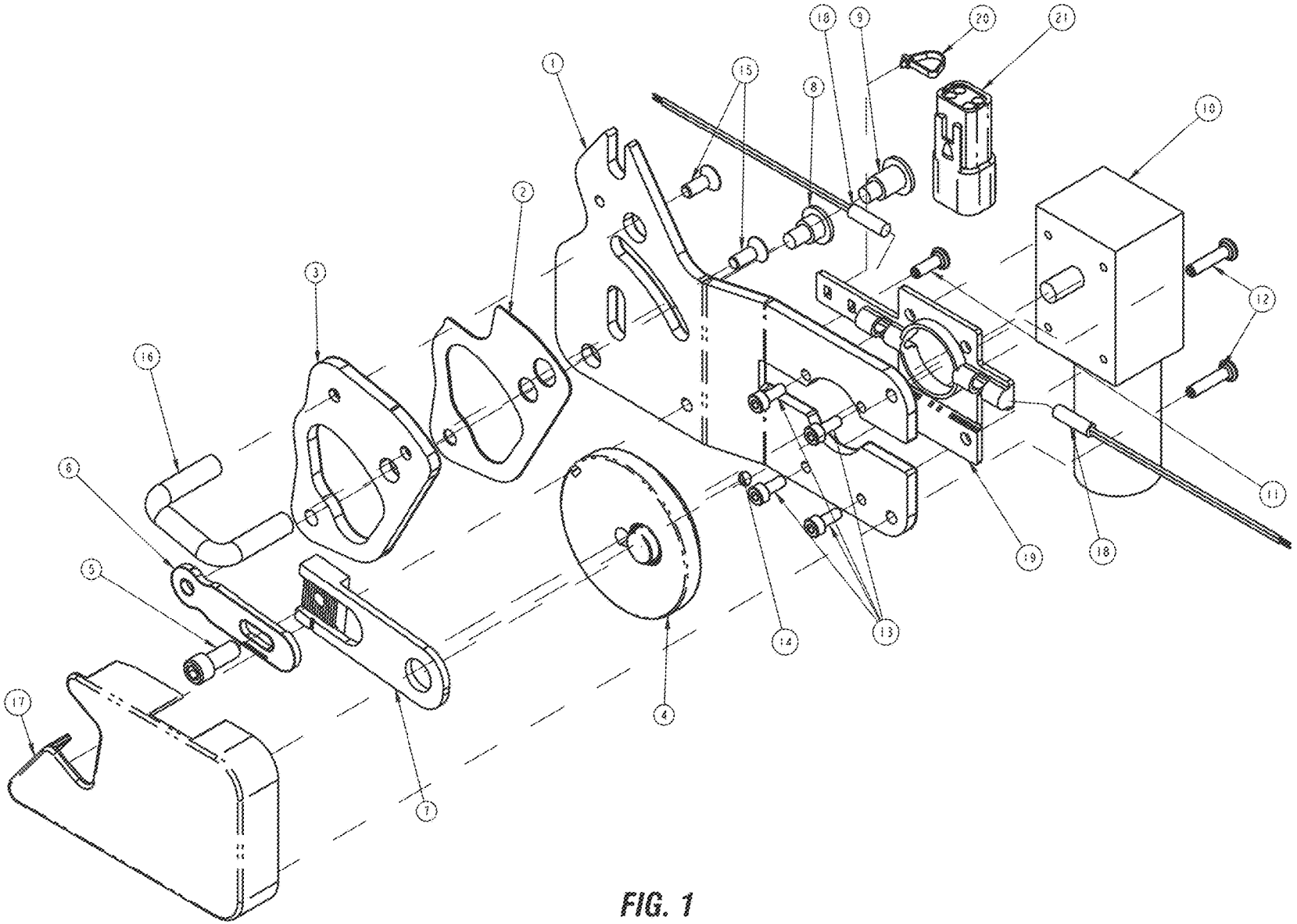
FIG. 1 is a perspective exploded view of the overall assembly with a hoop strike, with a first embodiment of the pivot plate, mount plate and drive motor.

The following part list describes the components and their functions, using reference numerals corresponding to the drawings.

1. Mount plate—provides mounting surfaces for all cinching mechanism parts and provides mounting and mounting adjustment details for mounting to the vehicle.

2. Glide—isolates the moveable pivot plate 3 from the mounting plate 1 to reduce friction and wear.

3. Pivot Plate—provides a base with a mounting surface for moveable apparatus, also has a pivot rivet mounting hole 67, and a pivot plate drive hole 58.

4. Torque Wheel—houses a magnet 14 for positional sensing, provides a drive feature for the motor interface, and a drive feature for a link that connects the torque wheel to the pivot plate 3.

5. Link Adjustment Screw—provides positive retention between the adjustable link components.

6. Driven Link—attaches to the pivot plate 3 via the drive rivet 9 and interfaces with the drive link 7 through the link adjustment screw 5.

7. Drive Link—attaches to the torque wheel 4 via the torque wheel drive pin 24 and interfaces with the driven link 6 through the link adjustment screw 5.

8. Pivot Rivet—retains the pivot plate 3 and the glide 2 to the mount plate 1, and allows the pivot plate 3 and the glide 2 to pivot via the pivot rivet pivot shoulder 59.

9. Drive Rivet—retains the driven link 6 to the pivot plate 3, drives the pivot plate 3 and glide 2 on through the drive rivet guide shoulder 60, and retains surface contact between the pivot plate 3, the glide 2 and the mount plate 1 through the pivot rivet retention head 62.

10. Drive Motor—provides rotational motion and torque to the torque wheel 4 to drive the mechanism. The motor is electric, and preferably rotates 360°, though a reversible motor can also be used.

11. Cover Screw—retains the cover 17 to the mount plate 1.

12. Cover Screw—retains the cover 17 to the mount plate 1.

13. Motor Mount Screw—retains the sensor retention plate 19 and the drive motor 10 to the mount plate 1.

14. Magnet—provides a magnetic field to be sensed by the extended/retracted position sensor.

15. Strike mount screw—retains the strike apparatus 16 to the pivot plate 3.

16. Hoop Strike—provides a latch retention surface for latching the occupant door.

17. Cover—covers all moveable part and retains the drive link 7 and the torque wheel 4 and maintains their contact.

18. Extended/Retracted Position Sensor—provides positional feedback by sensing the magnet 14 and opening or closing a circuit internal to itself that a cinching strike controller input can verify.

19. Sensor Retention Plate—provides for positive positional placement of the extended/retracted sensor 18, provides wire routing features, and location for a wire retaining zip tie 20 to be secured.

20. Wire Retaining Zip Tie—used to retain the wires and the connector 21 to the sensor retention plate 19.

Figure 3:
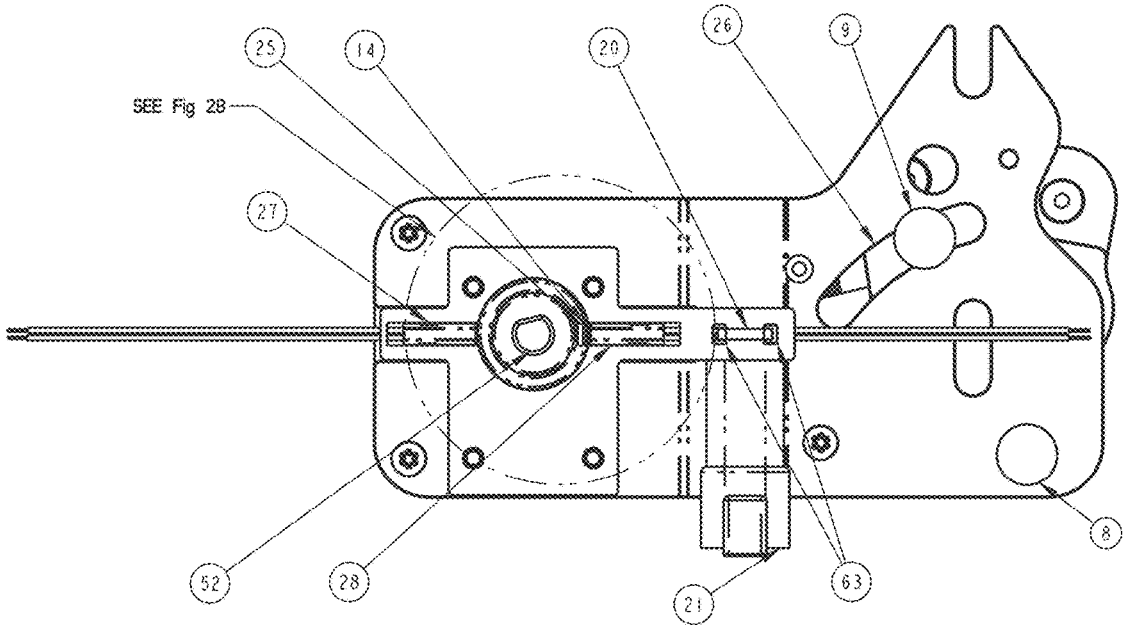
FIG. 3 is a rear plan view of the cinching door mechanism with motor hidden.

21. Wire Connector—used to connect the cinching door mechanism electrically to a cinching door mechanism controller, receives wiring from the drive motor 10 and the extended sensor 28 and the retracted sensor 27. (FIGS. 1 and 3.)

Figure 2:
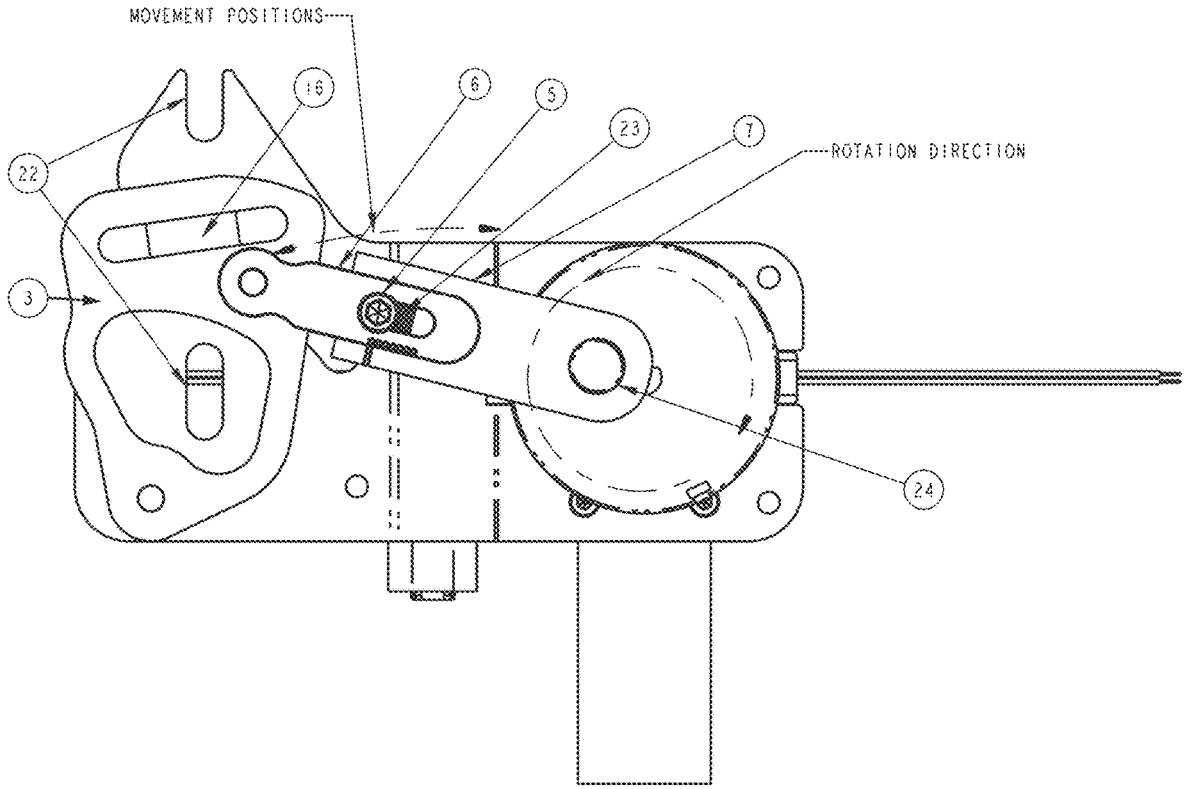
FIG. 2 is a front plan view of the cinching door mechanism with cover hidden.

22. Vertical adjustment slots—on the mount plate 1 and allows for the cinching door mechanism to be adjusted vertically on a vehicle mounting location. (FIG. 2)

Figure 10:
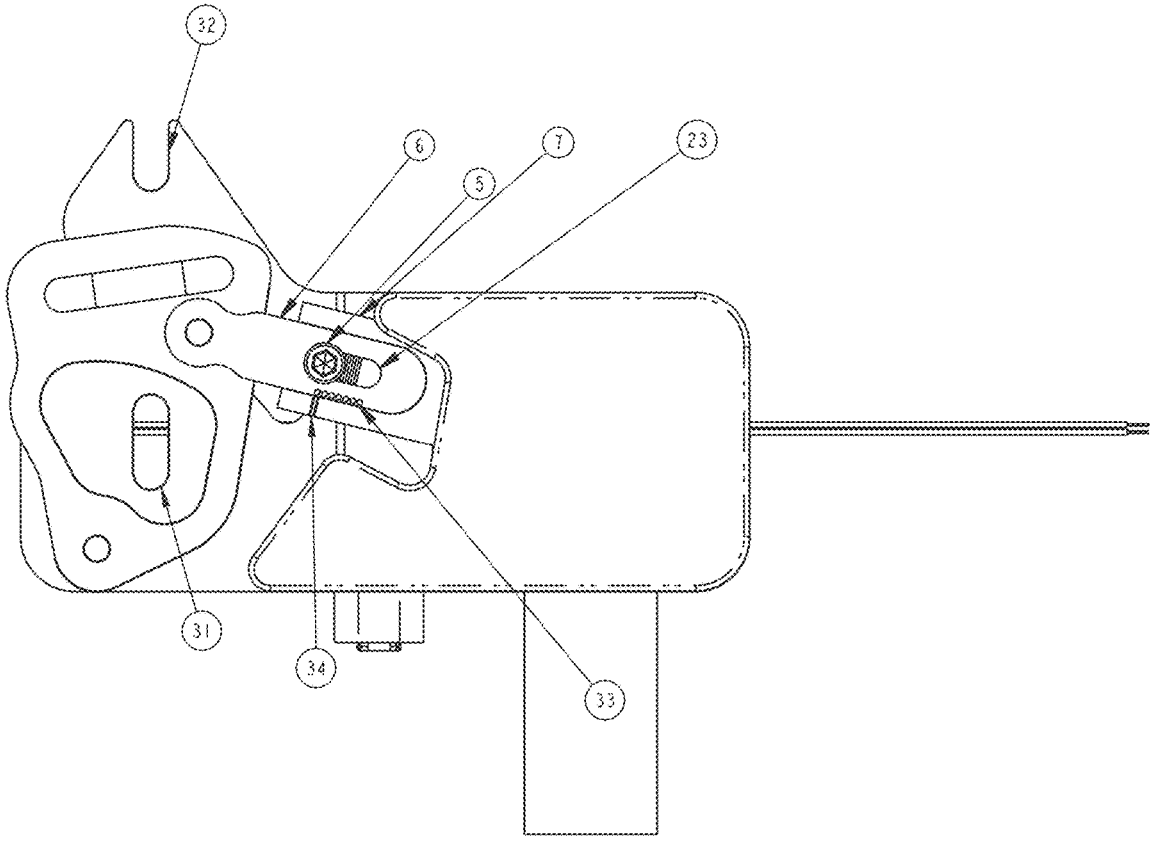
FIG. 10 is a front plan view of the cinching door mechanism of FIG. 1, showing full inboard adjustment of the driven link and fully extended strike.
Figure 11:
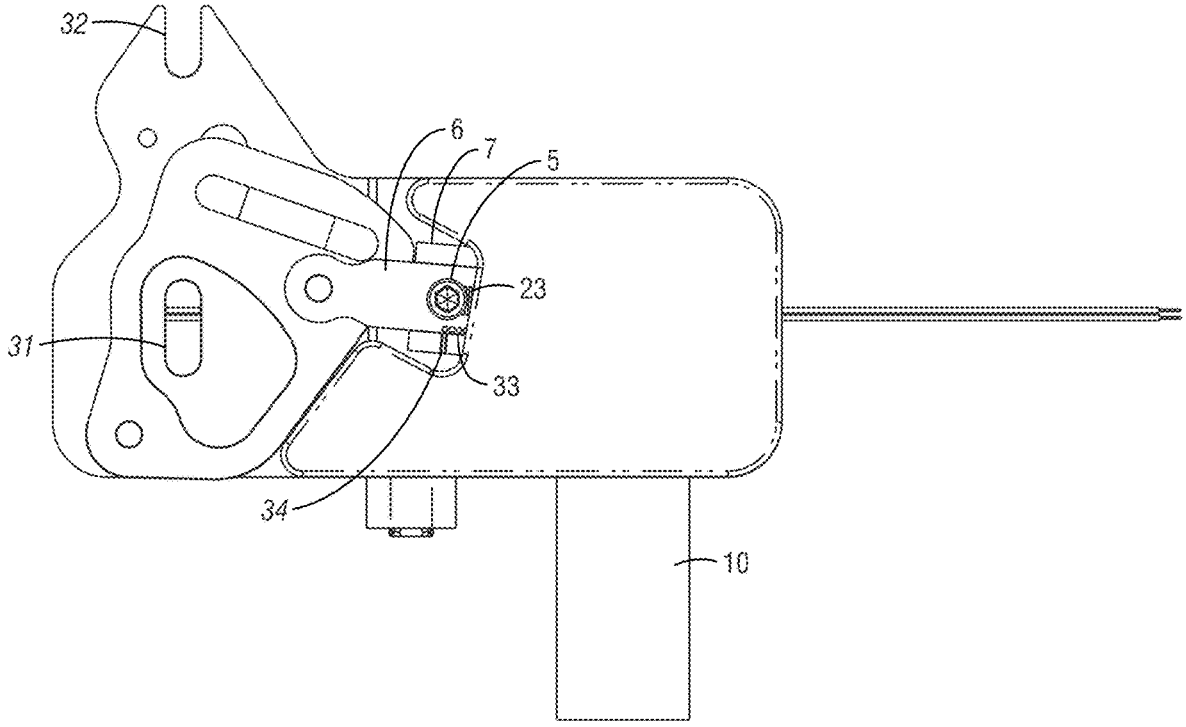
FIG. 11 is a front plan view of the cinching door mechanism of FIG. 1, showing full inboard adjustment of the driven link and fully retracted strike.
Figure 12:
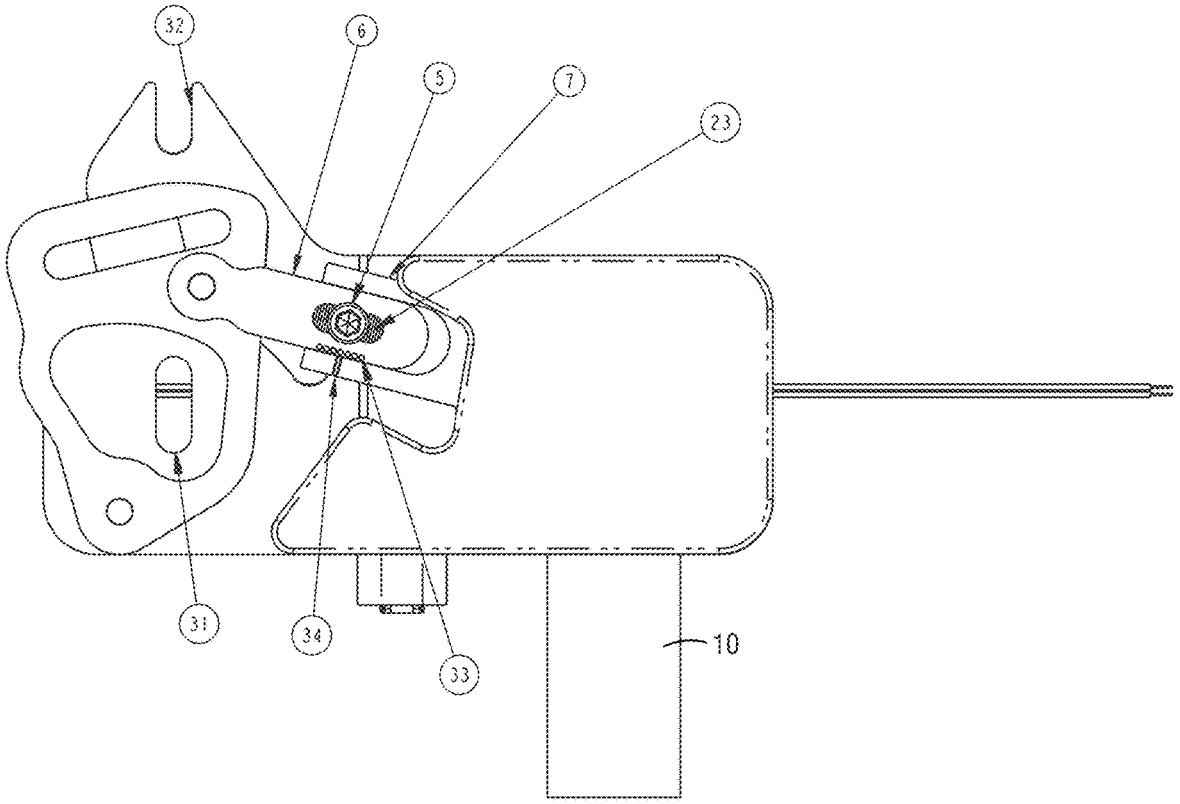
FIG. 12 is a front plan view of the cinching door mechanism of FIG. 1, showing centered inboard adjustment of the driven link and fully extended strike.
Figure 13:
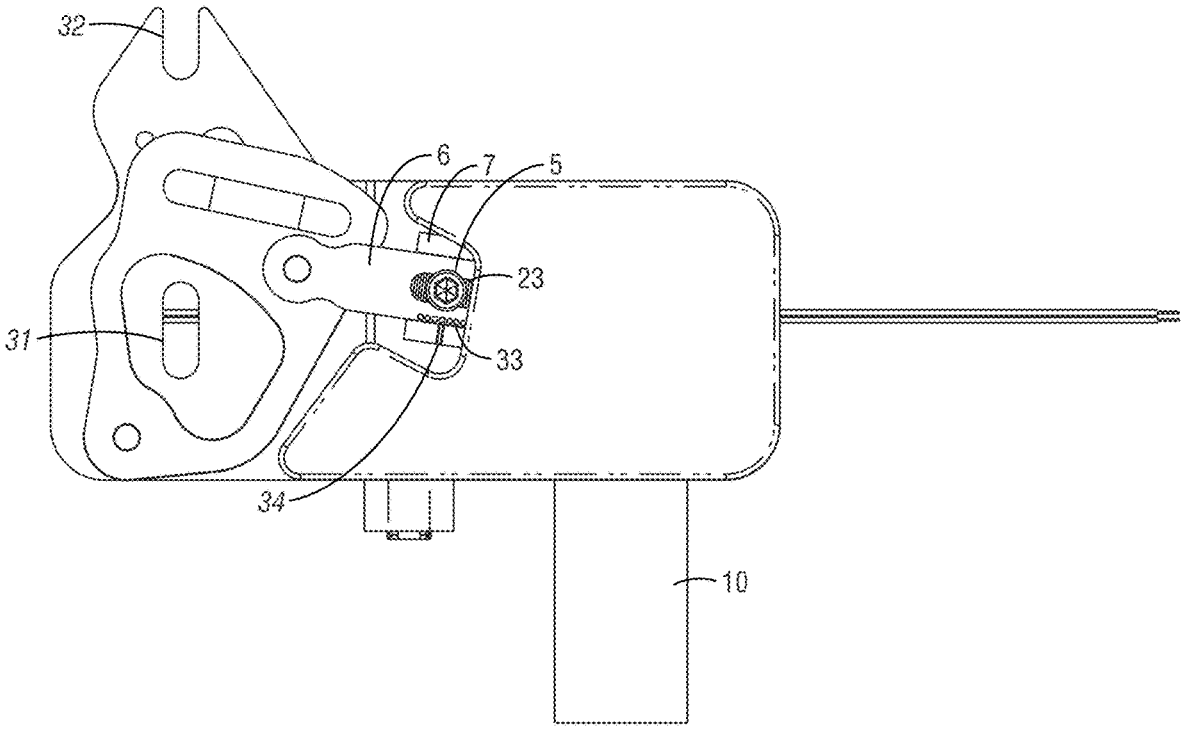
FIG. 13 is a front plan view of the cinching door mechanism of FIG. 1, showing centered inboard adjustment of the driven link and fully retracted strike.
Figure 14:
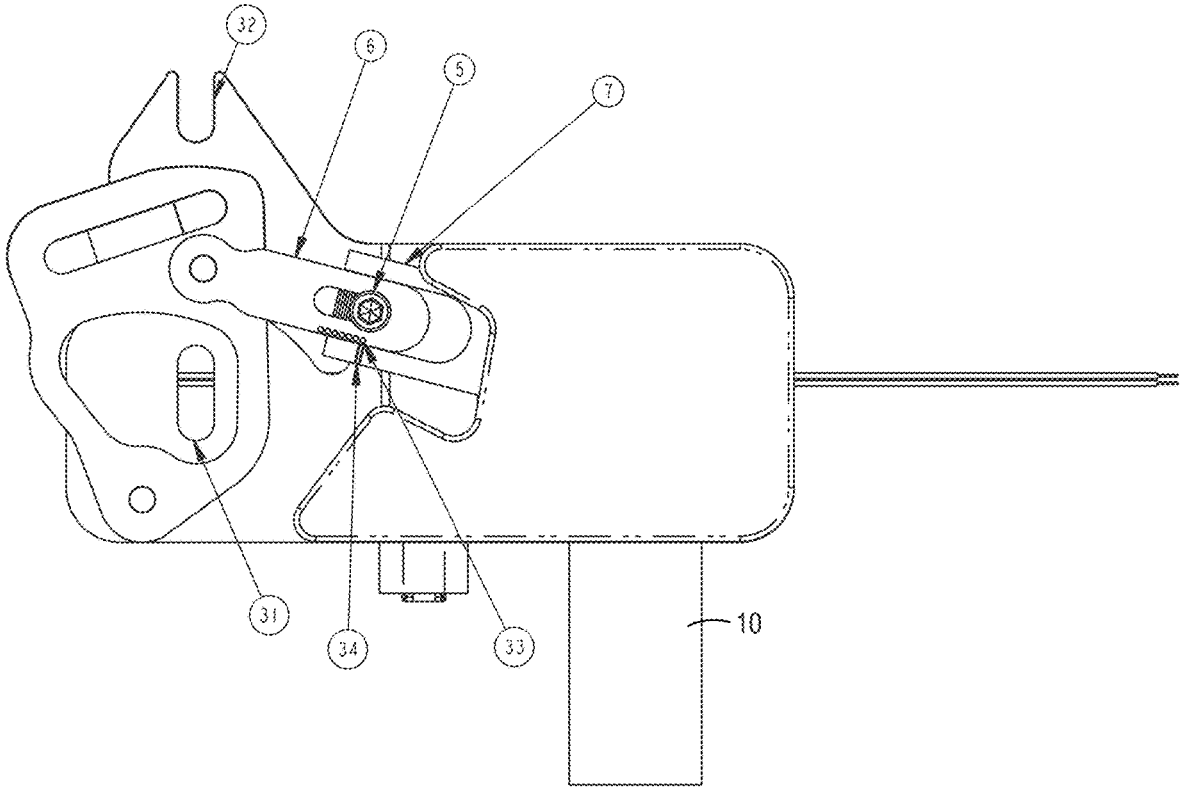
FIG. 14 is a front plan view of the cinching door mechanism of FIG. 1, showing full outboard adjustment of the driven link and fully extended strike.
Figure 15:
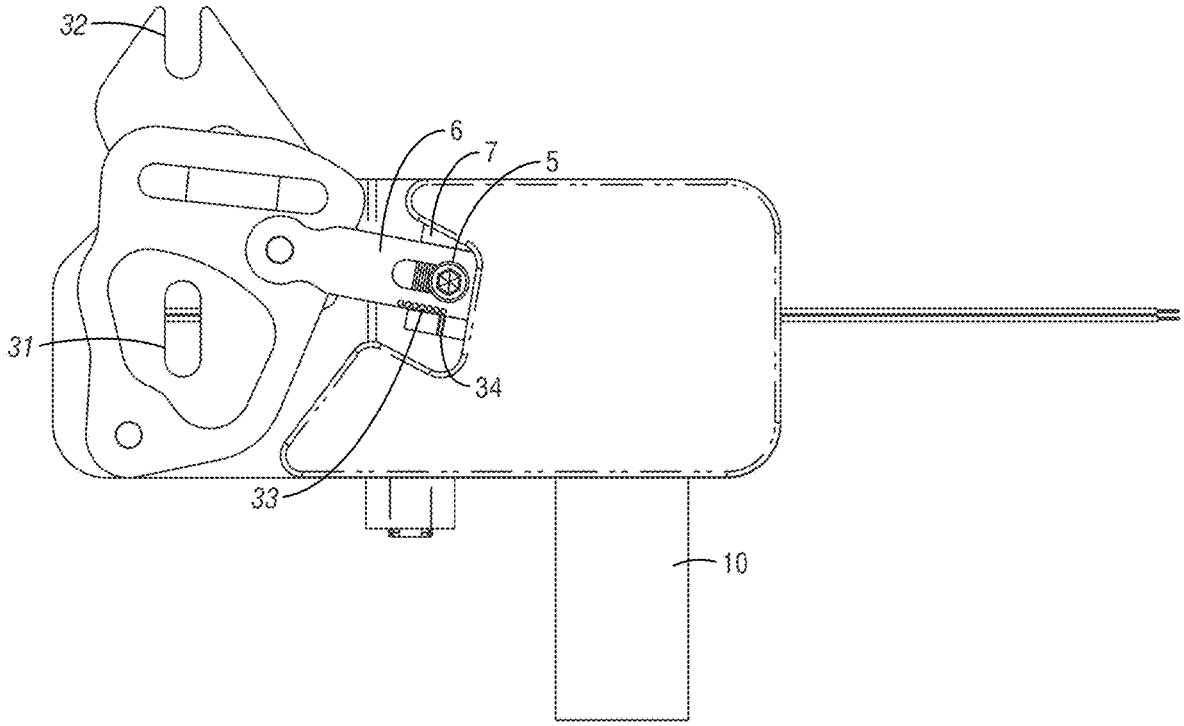
FIG. 15 is a front plan view of the cinching door mechanism of FIG. 1, showing full outboard adjustment of the driven link and fully retracted strike.

23. Extension/Retraction adjustment slot—in the driven link 6 and allows a place for the link adjustment screw to pass through and provides adjustment limits. (FIGS. 2 and 10.)

Figure 23:
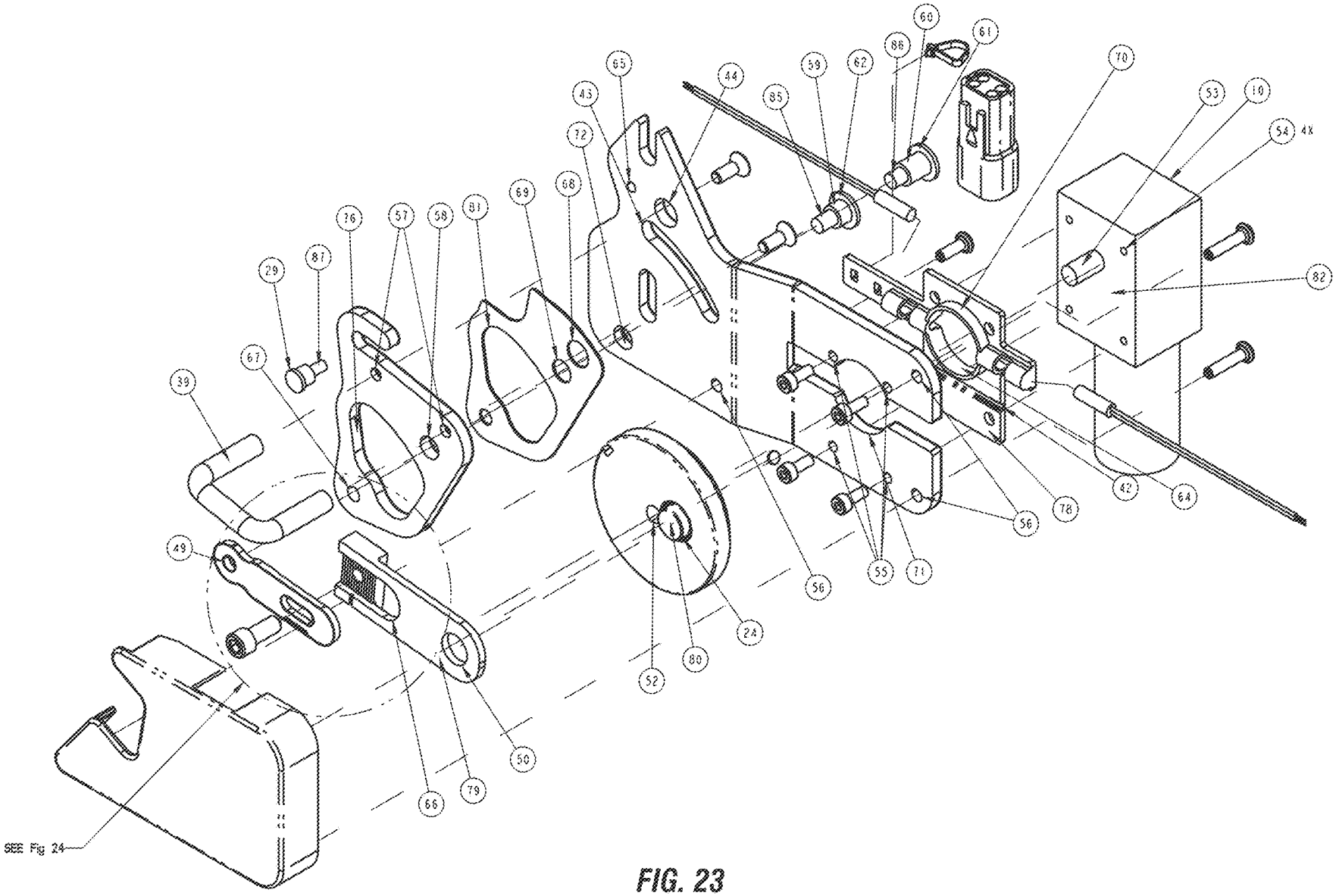
FIG. 23 is a perspective exploded view of the overall assembly with the hoop strike and longitudinal loading rivet and the alternative longitudinal loading pivot plate shown in FIG. 4.

24. Torque wheel drive pin—mates with the drive link drive hole 50 to provide a place for an interface to the drive link 7 and the torque wheel 4 (FIG. 23).

25. Magnet pocket—provides a place for the magnet 14 to be attached to the torque wheel 4 (FIG. 3).

26. Arcuate Drive Rivet Slot—in the mount plate 1 to provide sliding guide for the drive rivet 9 to pass through the mount plate 1, thus allowing the drive rivet head to be on the back side of the mount plate 1 so as to retain the pivot plate 3 and the glide 2 to the mount plate 1 (FIG. 3).

27. Retracted Sensor Position—senses the magnet 14 to tell the cinching door mechanism controller to stop motion that mechanism is retracted (FIG. 3).

28. Extended Sensor Position—senses the magnet 14 to tell the cinching door mechanism controller to stop motion that mechanism is extended (FIG. 3).

Figure 5:
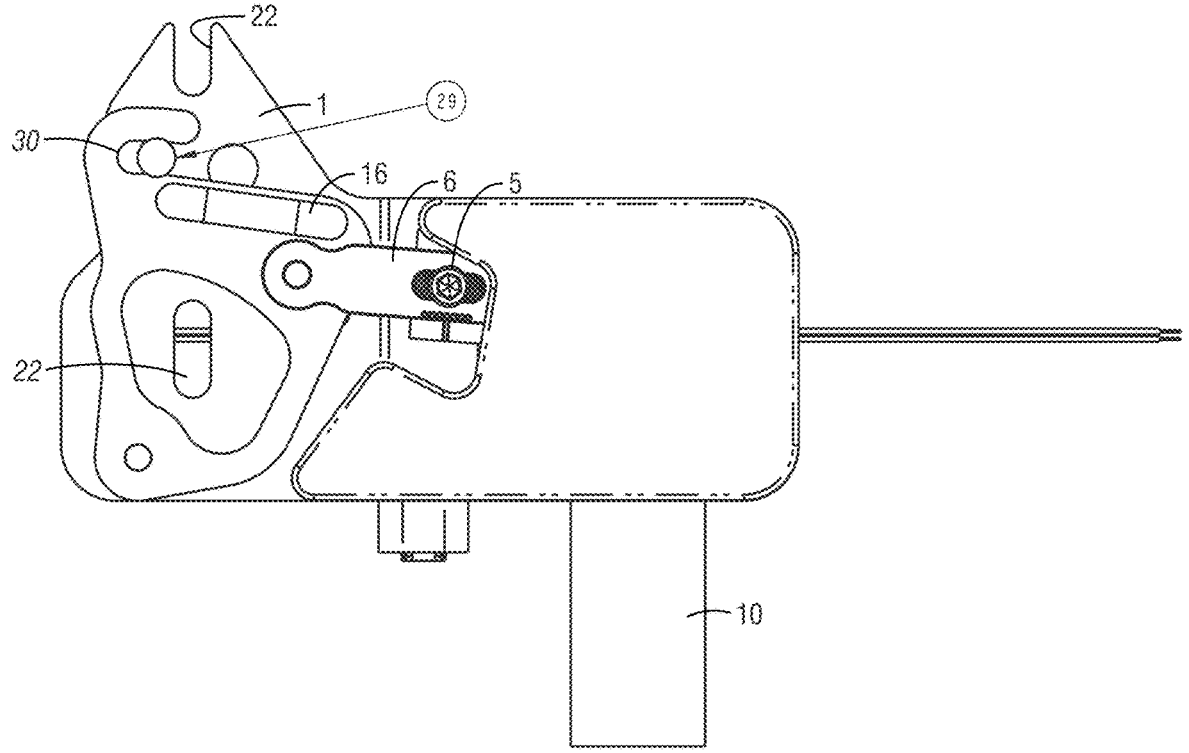
FIG. 5 is a front plan view of the cinching door mechanism of FIG. 4, showing ½ engagement of the longitudinal loading rivet and the longitudinal loading slot.
Figure 6:
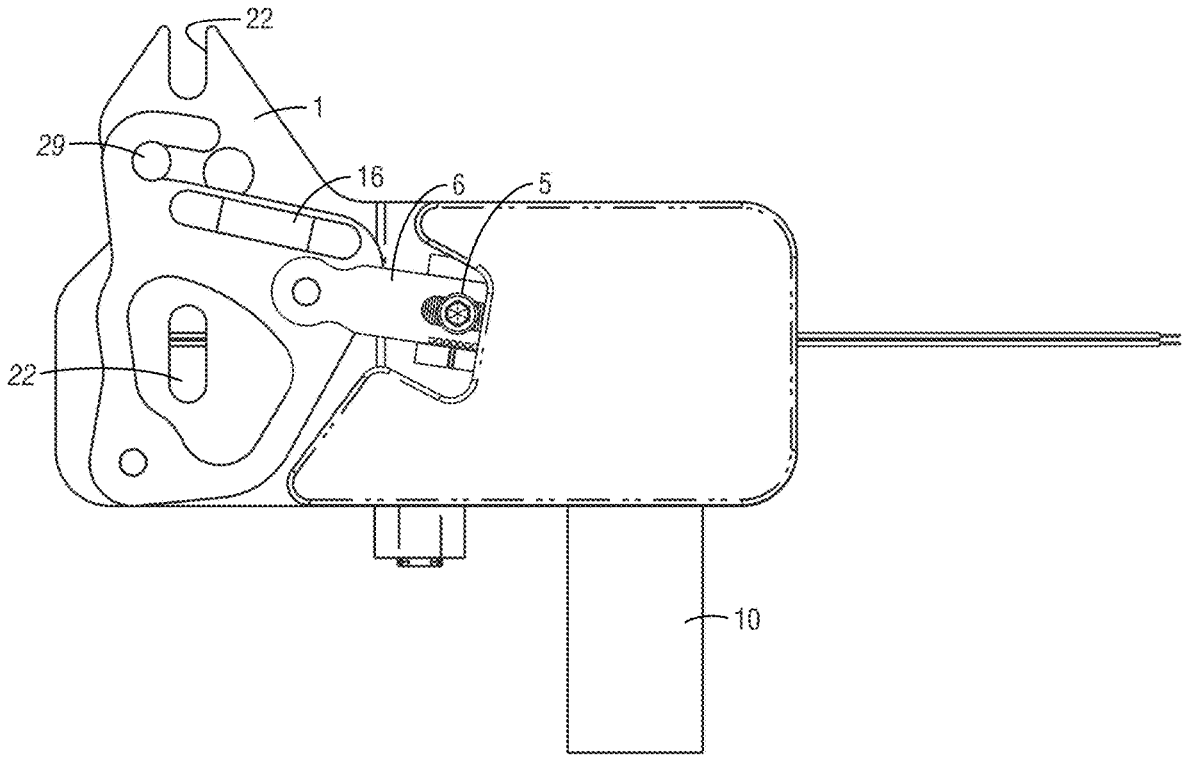
FIG. 6 is a front plan view of the cinching door mechanism of FIG. 4, showing full engagement of the longitudinal loading rivet and the longitudinal loading slot.
Figure 7:
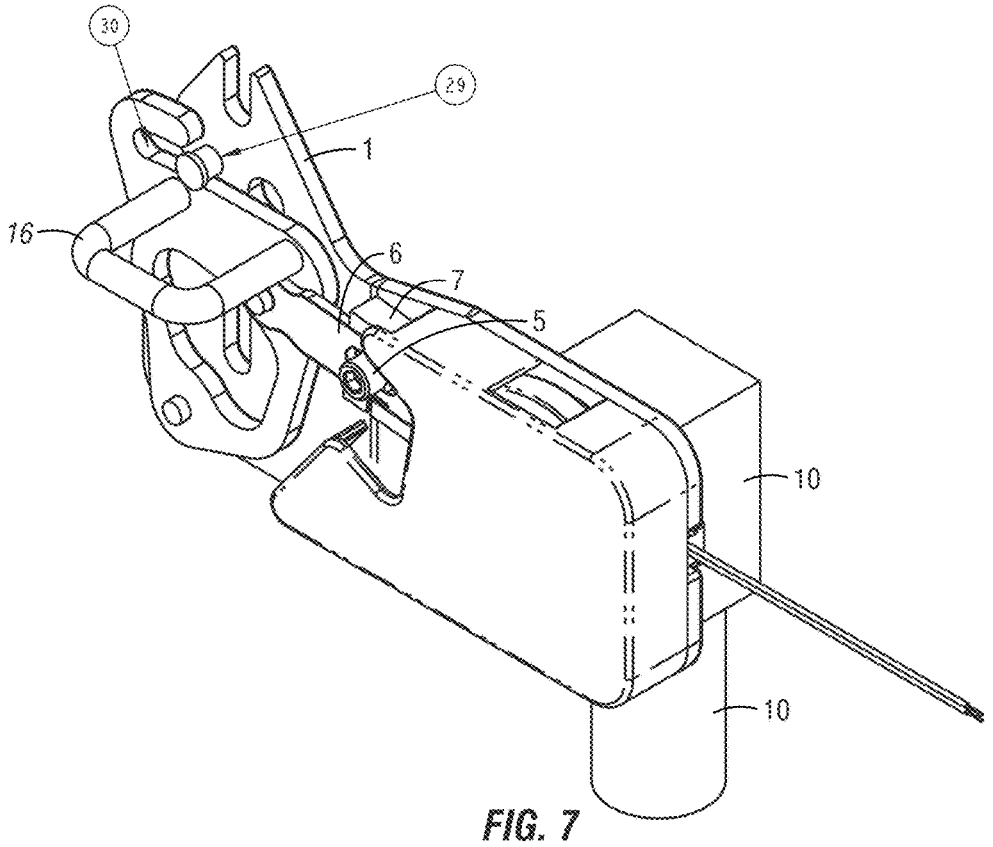
FIG. 7 is a perspective view of the cinching door mechanism of FIG. 4, showing no engagement of the longitudinal loading rivet and the longitudinal loading slot.
Figure 8:
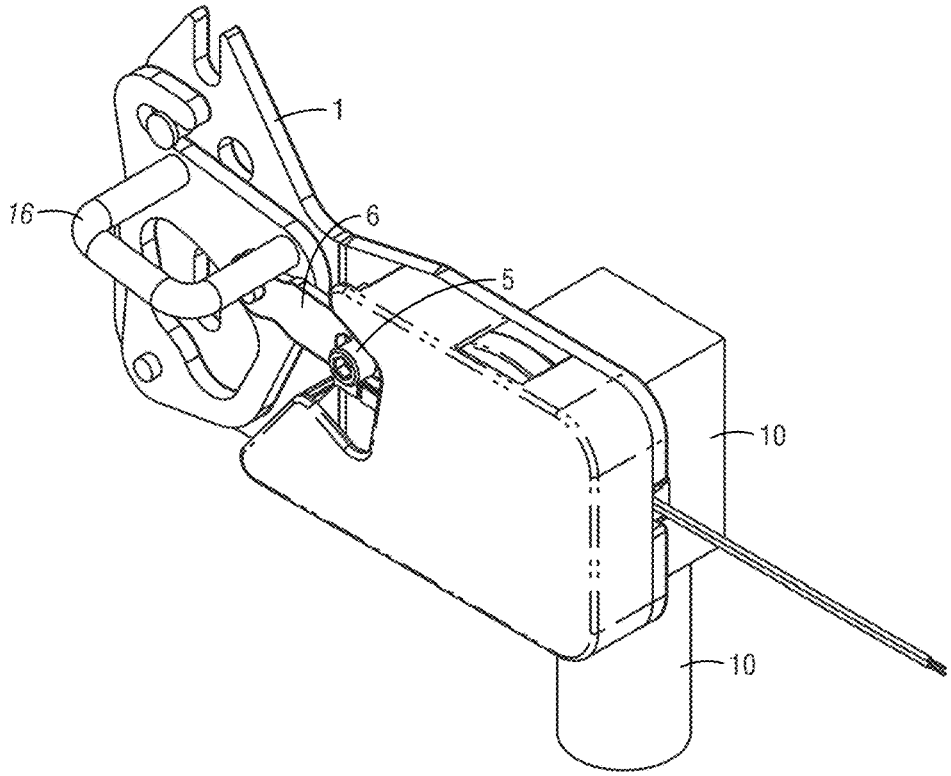
FIG. 8 is a perspective view of the cinching door mechanism showing ½ engagement of the longitudinal loading rivet and longitudinal loading slot.
Figure 9:
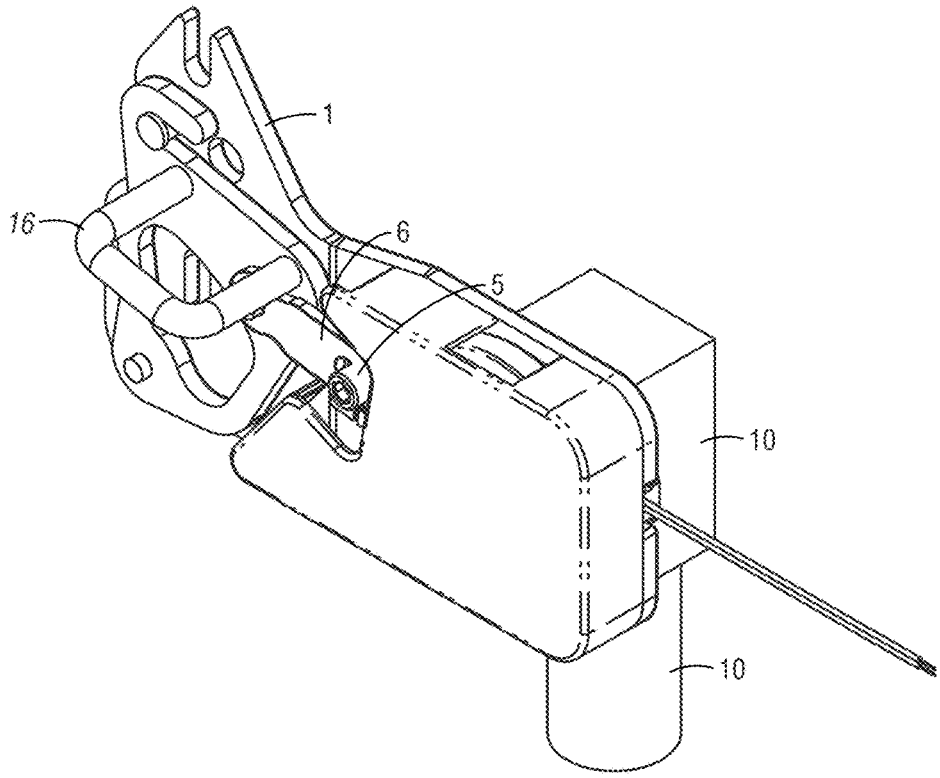
FIG. 9 is a perspective view of the cinching door mechanism of FIG. 4, showing full engagement of the longitudinal loading rivet and the longitudinal loading slot.

29. Longitudinal loading rivet—retains an upper part of the pivot plate 3 to the mount plate 1 when longitudinal load is placed on the strike device 16, 35. (FIGS. 5 and 7.)

Figure 4:
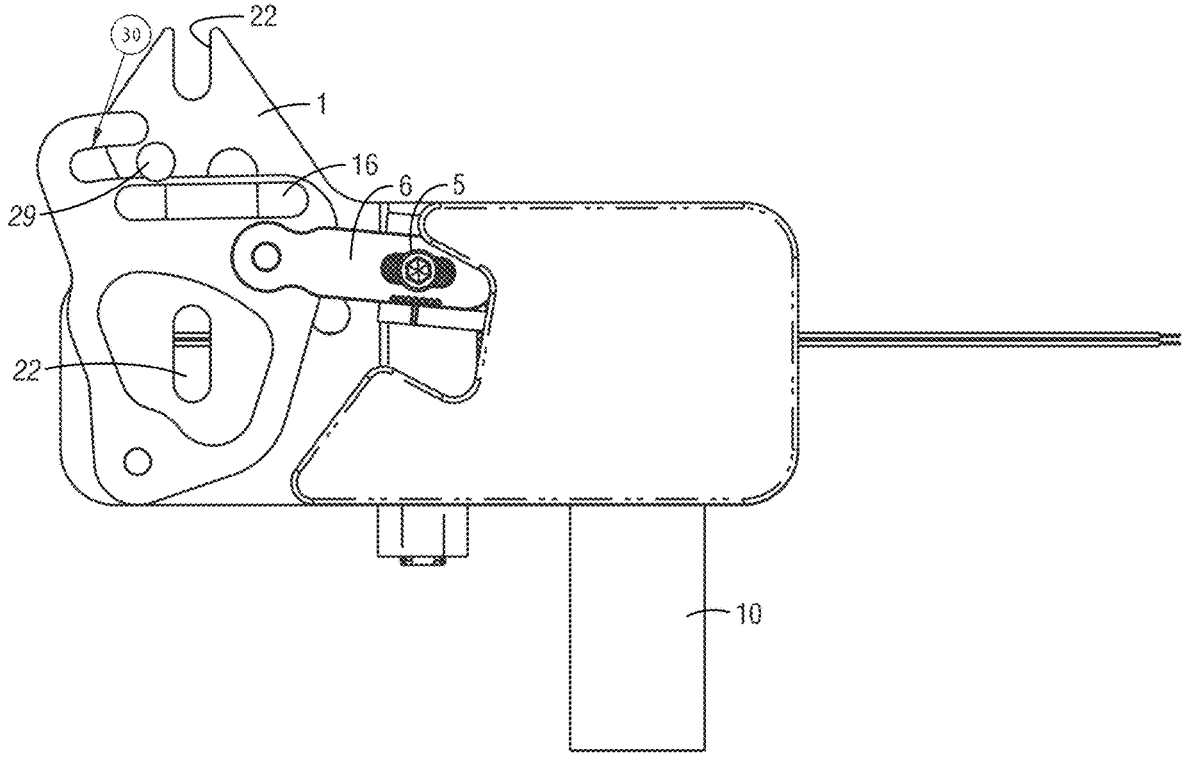
FIG. 4 is a front plan view of the cinching door mechanism with an alternative embodiment pivot plate, showing no engagement of the longitudinal loading rivet and longitudinal loading slot.

30. Longitudinal loading slot—in the pivot plate 3 to provide a place for interface of the pivot plate 3 to the longitudinal loading rivet 29. (FIGS. 4 and 7).

Figure 20:
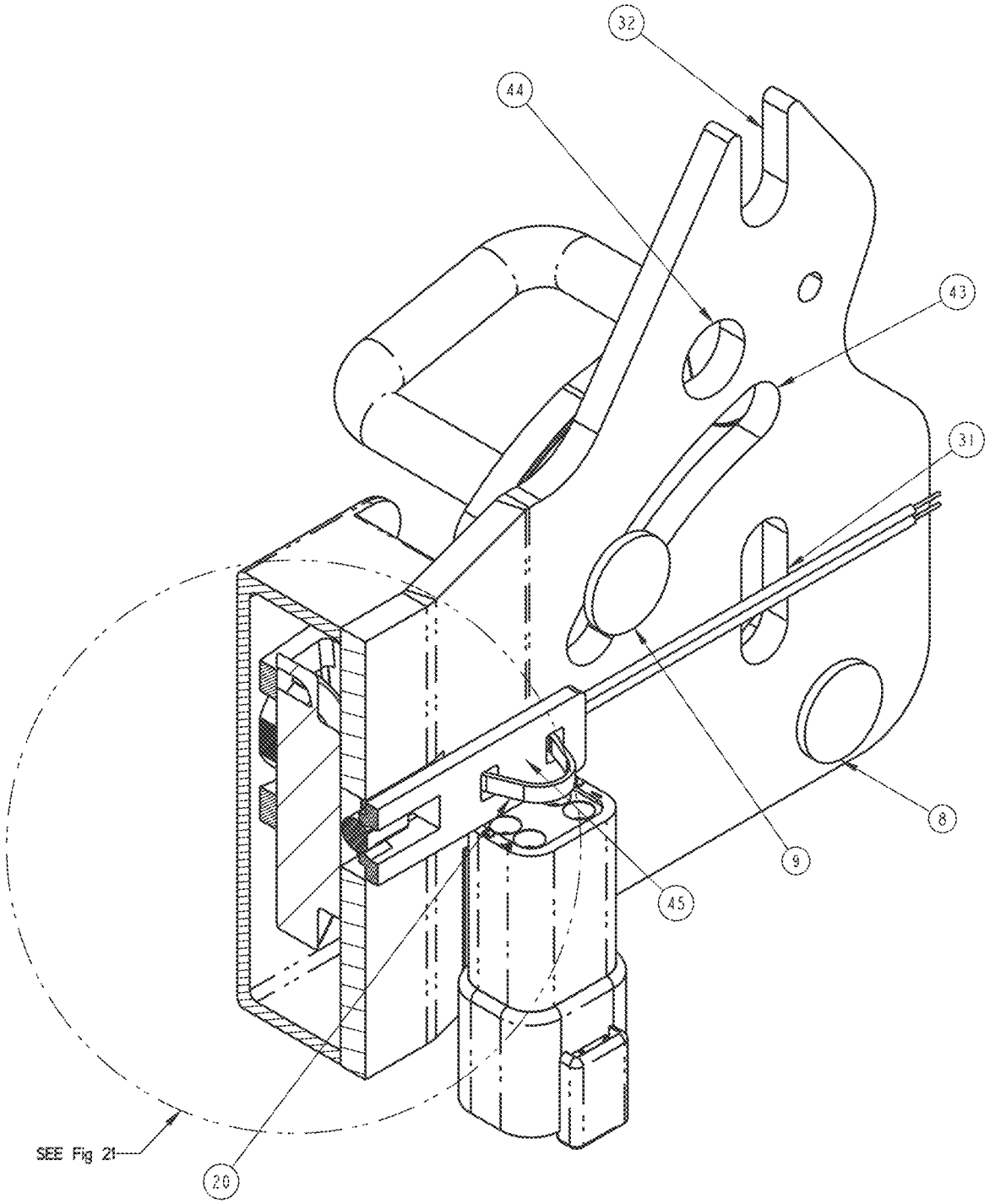
FIG. 20 is a section view of FIG. 19 showing wire routing details (wires not shown).

31. Lower vertical adjustment slot—one of the slots 22 in the mount plate 1 to provide interface for the mounting fastener, and to allow for vertical adjustment of the cinching mechanism. (FIGS. 10 and 20.)

32. Upper vertical adjustment slot—one of the slots 22 in the mount plate 1, to provide interface for mounting the fastener, and to allow for vertical adjustment of the cinching mechanism. (FIGS. 10 and 20.)

33. Link adjustment indicators—on the drive link 7 to provide finite adjustment indicators for the driven link 6. (FIG. 10.)

34. Link adjustment mark—on the drive link 7 to provide a finite adjustment indication alignment mark for the drive link 7. (FIG. 10.)

Figure 16:
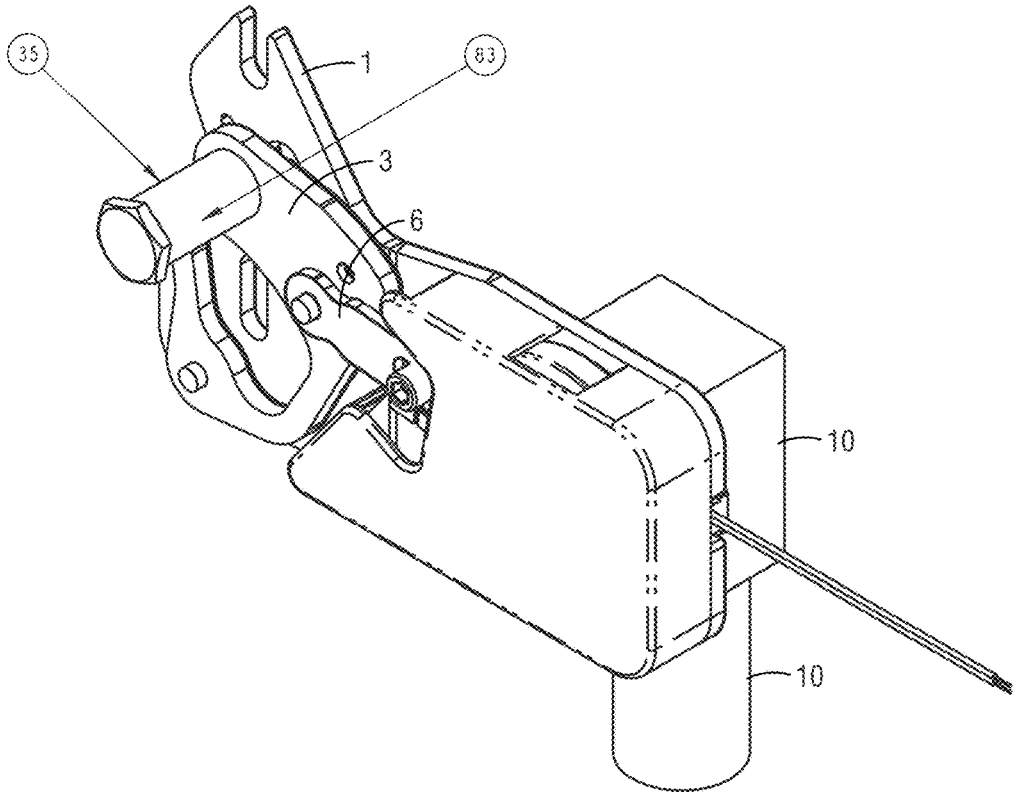
FIG. 16 is a perspective view of the overall assembly with a strike bolt attached to the pivot plate.
Figure 17:
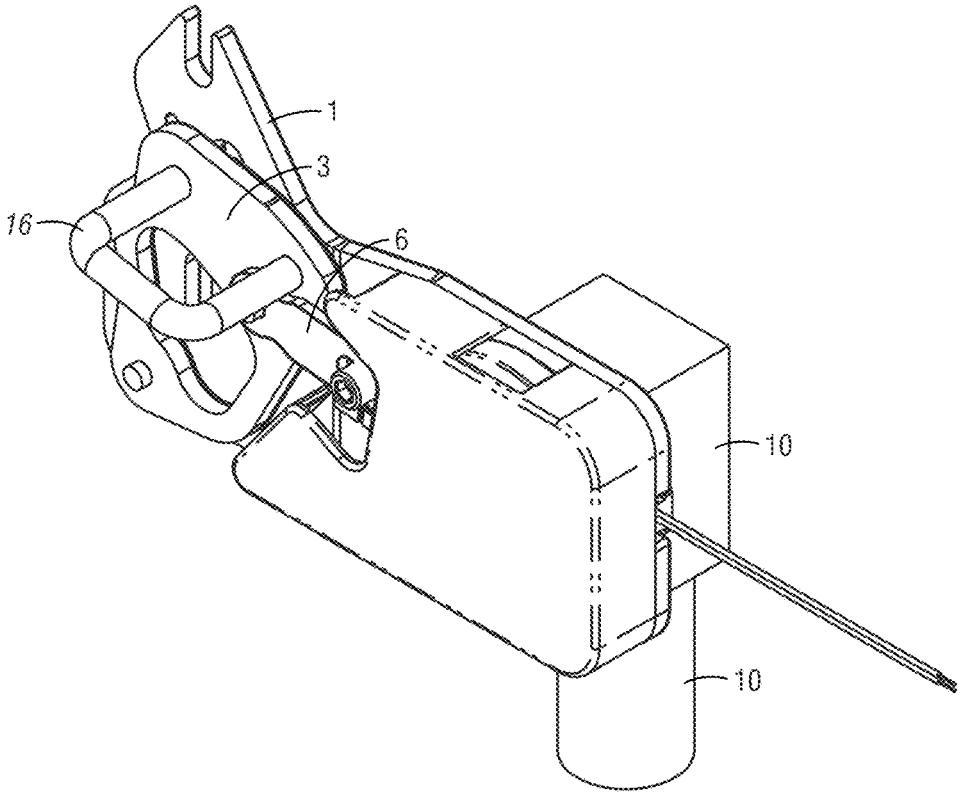
FIG. 17 is a perspective view of the overall assembly with a hoop strike attached to the pivot plate.
Figure 18:
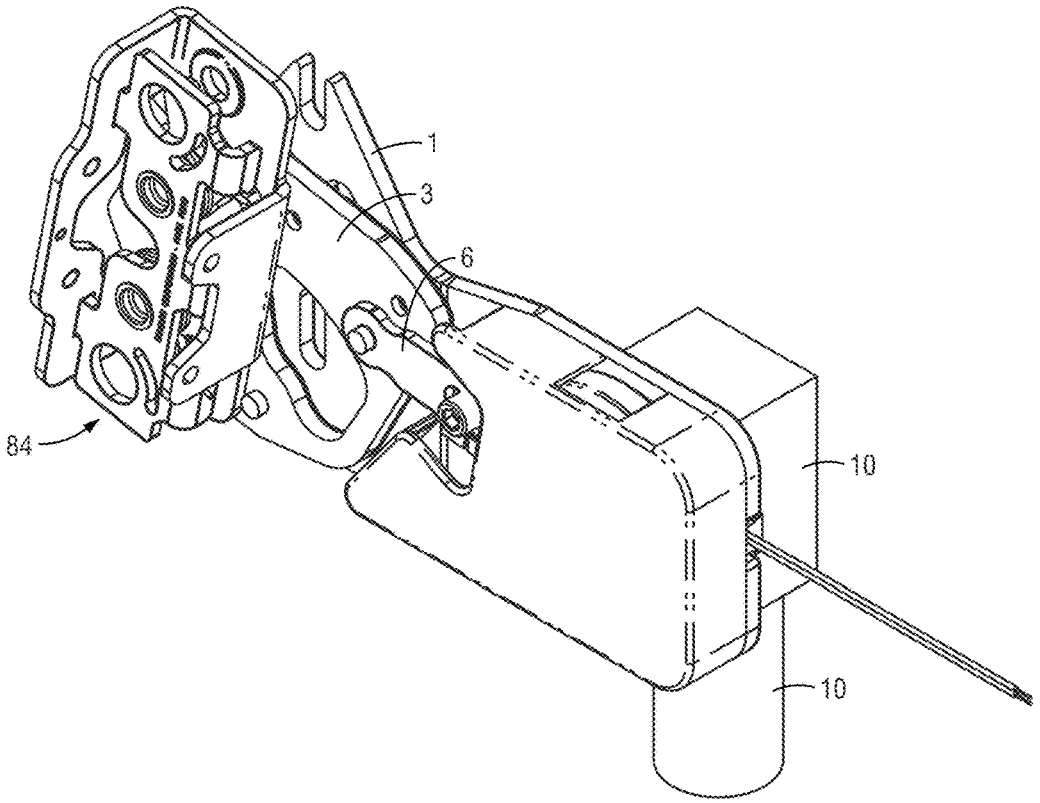
FIG. 18 is a perspective view of the overall assembly with the rotary latch attached to the pivot plate.
Figure 19:
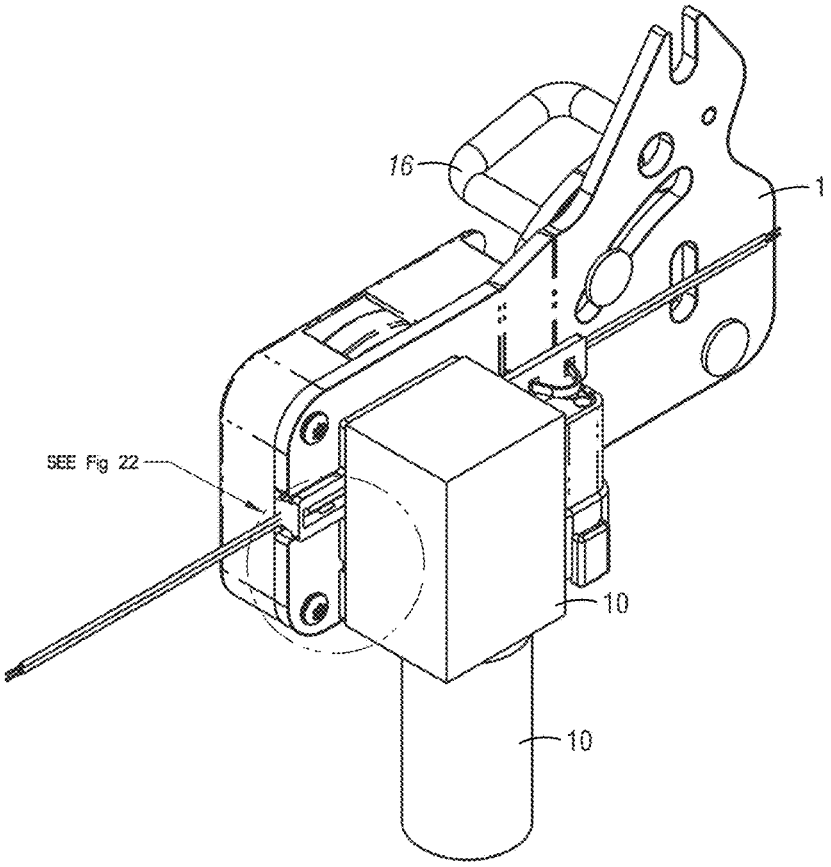
FIG. 19 is a rear perspective view of the overall assembly with the hoop strike attached to the pivot plate.

35. Strike bolt—alternative strike interface that can be mounted on the pivot plate 1 in place of a hoop strike 16. (FIG. 16.)

Figure 27:
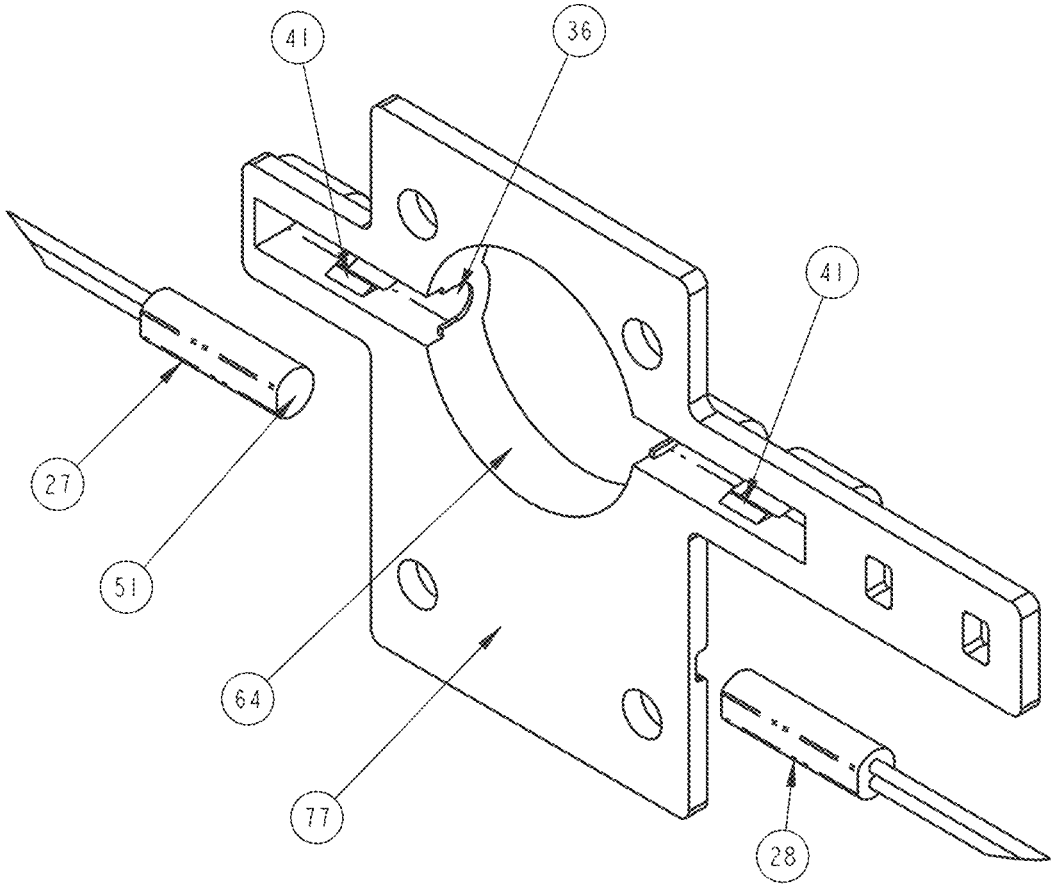
FIG. 27 is a detail view of FIG. 25 showing details of the sensor retention plate and extended/retracted sensors.
Figure 28:
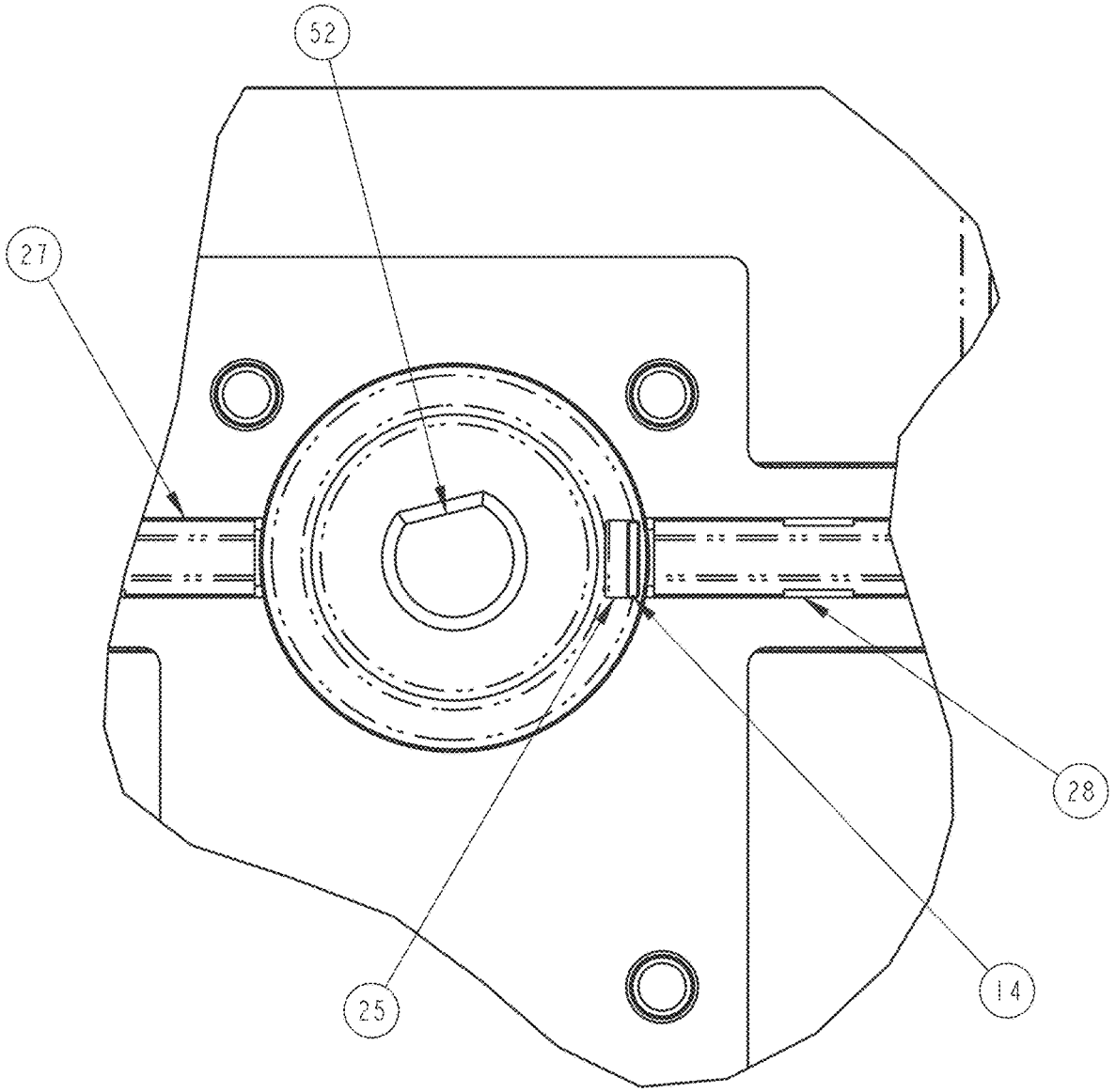
FIG. 28 is a detail view of FIG. 3 showing details of the position sensors, magnet, and magnet pocket.

36. Sensor retention plate pocket—U-shaped channel in the sensor retention plate 19 that accepts the extended sensor 28 and retracted sensor 27. (FIG. 27.)

Figure 25:
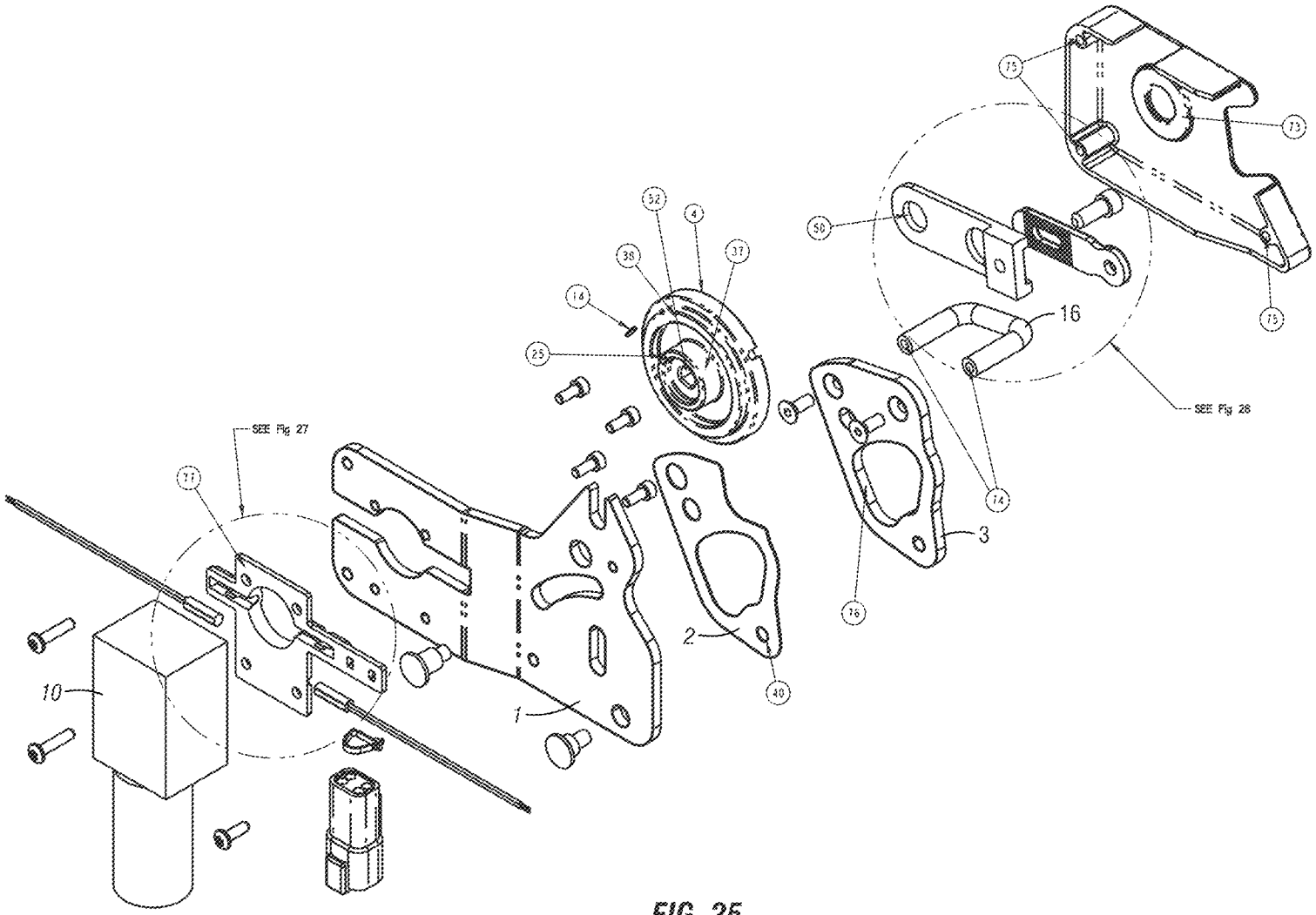
FIG. 25 is a rear perspective exploded view of the overall assembly with the hoop strike attached to the pivot plate.

37. Torque wheel pivot guide shaft—provides a bearing surface for torque wheel 4 to rotate about and takes side loading. (FIG. 25.)

38. Torque wheel bearing surface—provides a bearing surface for the torque wheel 4 to rest against the mount plate 1. (FIG. 25.)

39. Hoop strike latch retention surface—location where latching the device attaches the door to the cinching door mechanism. (FIG. 23.)

40. Pivot rivet mounting hole—pivot hole in the glide 2 that the glide pivots about, and maintains the relationship between the pivot plate 3 and the mount plate 1. (FIG. 25.)

Figure 21:
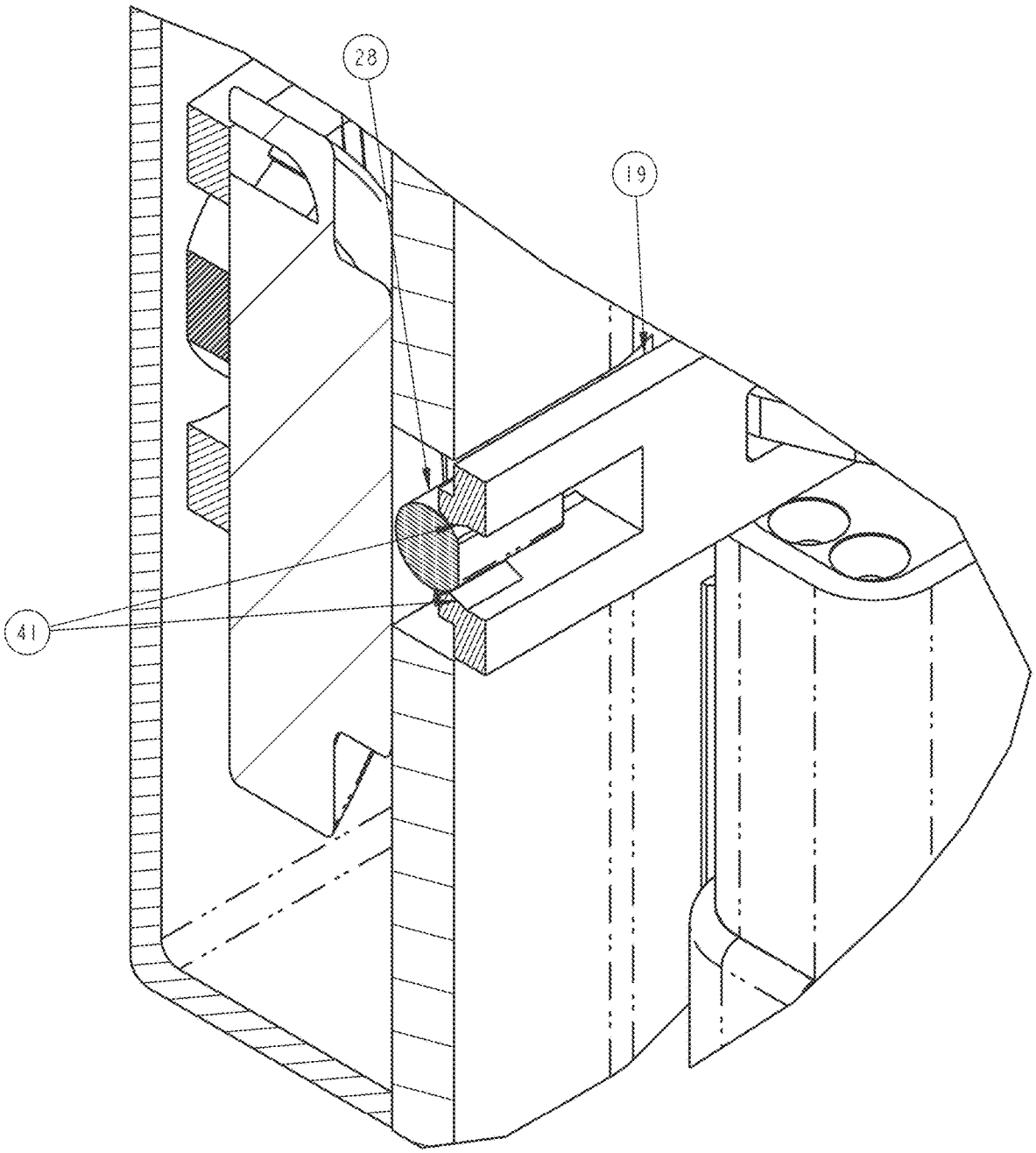
FIG. 21 is a detail view of FIG. 20 showing the position sensor retention barbs.

41. Sensor retention barb—protrusion in the sensor retention plate sensor pocket 36 that retains the extended sensor 28 and the retracted sensor 27. (FIGS. 21 and 27.)

Figure 22:
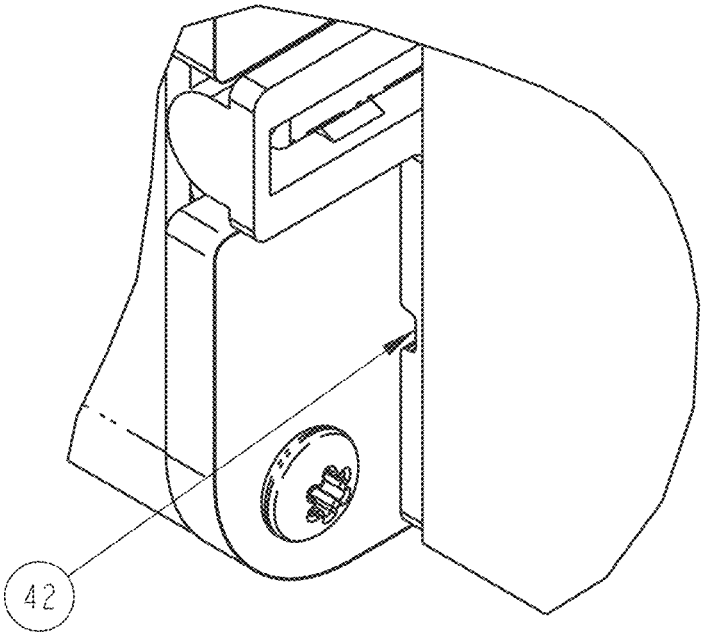
FIG. 22 is a detail view of FIG. 19 showing wire routing detail.

42. Wire routing path—channel created under the sensor retention plate 19 for wire routing. (FIGS. 22 and 23.)

43. Drive rivet retention slot—slot that controls the drive rivet 9 and allows for the drive rivet 9 to move the pivot plate 3 on the mount plate 1. (FIGS. 20 and 23.)

44. Strike mount screw access hole—allows for access to the strike mount screw 15 through the mount plate 1. (FIGS. 20 and 23.)

45. Wire routing path—path between the wire retaining zip tie 20 and the sensor retention plate 19. (FIG. 20.)

Figure 26:
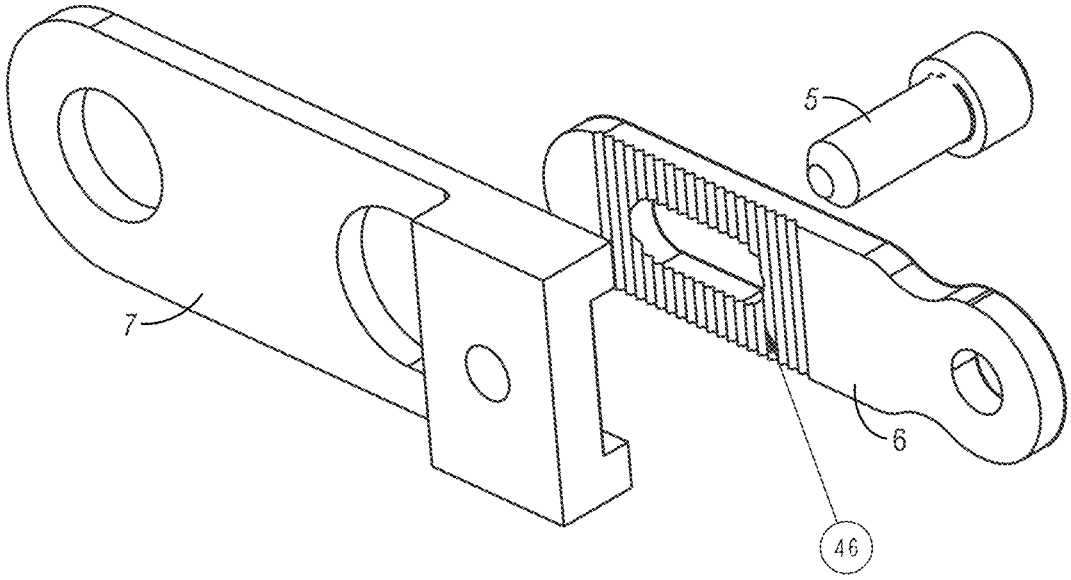
FIG. 26 is a detail view of FIG. 25 showing details of the drive and driven link adjustment features.

46. Driven link adjustment retention feature—provides a tooth featured surface on the driven link that locks the driven link 6 to the drive link 6 when the link 7 adjustment screw 5 is tightened. (FIG. 26.)

Figure 24:
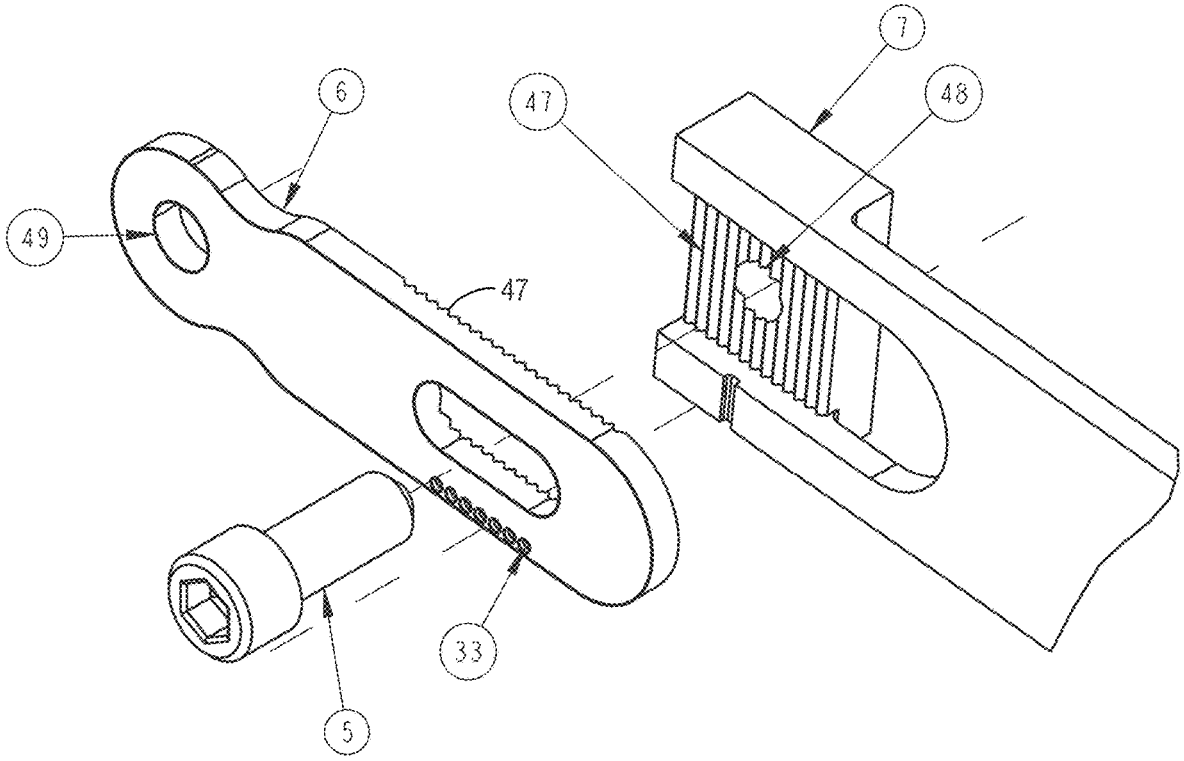
FIG. 24 is a detail view of FIG. 23 showing details of drive and driven link adjustment features.

47. Drive link adjustment retention feature—provides a tooth featured surface that locks the driven link 6 to the drive link 7 when the link adjustment screw 5 is tightened. (FIG. 24.)

48. Link adjustment screw mounting hole—threaded hole in the drive link 7 that receives the link adjustment screw 5 and allows the link adjustment screw 5 to be threaded into the drive link 7. (FIG. 24.)

49. Driven link mounting hole—receives the drive rivet 9 to retain and drive the pivot plate 3 and the glide 2 through the drive rivet retention slot 43. (FIGS. 23 and 24.)

50. Drive link drive hole—receives the torque wheel drive pin 24 on the torque wheel 4 which allows the torque wheel 4 to drive the drive link 7. (FIG. 23.)

51. Sensor Face—Face of the extended/retracted sensor 18 that is oriented near the magnet 14 to sense the magnetic field. (FIG. 27.)

52. Torque wheel center drive—receives the motor drive shaft 53 to transfer rotation and torque to the torque wheel 4. (FIG. 25.)

53. Motor drive shaft—transfers rotation and torque from the drive motor 10 to the torque wheel 4 to drive the cinching door mechanism. (FIG. 23.)

54. Motor mounting holes—threaded holes that allow for the motor mount screw 13 to be threaded into the motor 10. (FIG. 23.)

55. Motor mounting holes—clearance hole in the mount plate 1 that allow for the motor mount screw 13 to pass through and align the drive motor 10 to the mount plate 1, also retains the drive motor 10 so it can pass rotation and torque to the torque wheel 4. (FIG. 23.)

56. Cover mounting holes—holes in the mount plate 1 that accept the cover screw 11, 12. (FIG. 23.)

57. Strike mounting holes—holes in the pivot plate 3 that allow the strike mount screw 15 to pass through and attach the strike apparatus 16, 35. (FIG. 23.)

58. Pivot plate drive hole—accepts the drive rivet 9, and more specifically, the drive rivet guide shoulder 60 and drives the pivot plate 3. (FIG. 23.)

59. Pivot rivet pivot shoulder—fits into the pivot rivet pivot hole 72 and allows rotational motion between the mount plate 1, the pivot plate 3, and the glide 2. (FIG. 23.)

60. Drive rivet guide shoulder—fits into drive rivet retention slot 43 to control movement of the pivot plate 3 and the glide 2, and passes through the drive rivet retention slot 43, the glide rivet drive hole 69, and the pivot plate drive hole 58. (FIG. 23.)

61. Drive rivet retention head—maintains contact with the mount plate surface to retain contact of the mount plate 1, the glide 2, and the pivot plate 3. (FIG. 23.)

62. Pivot rivet retention head—maintains contact with the mount plate surface to retain contact of the mount plate 1, the glide 2, and the pivot plate 3. (FIG. 23.)

63. Wire routing retention zip tie mounting holes—access holes in the sensor retention plate 19 that allow the wire retaining zip tie 20 to be looped through to retain wires. (FIG. 3.)

64. Torque wheel pivot guide bore—accepts the torque wheel pivot guide shaft 37 to provide a bearing surface for side load of the torque wheel 4. (FIG. 27.)

65. Longitudinal load rivet mounting hole—accepts the longitudinal loading rivet mount shoulder 87 to fasten the longitudinal loading rivet 29 to the mount plate 1. (FIG. 23.)

66. Driven link guide slot—provides for perimeter support of the driven link 6 so that the driven link 6 is not allowed to rotate about the link adjustment screw 5. (FIG. 23.)

67. Pivot rivet mounting hole—accepts the pivot rivet mount shoulder 85 and affixes the pivot rivet 8 to the pivot plate 3. (FIG. 23.)

68. Strike mount screw access hole—allows for access to the strike mount screw 15 through the glide 2. (FIG. 23.)

69. Glide rivet drive hole—accepts the drive rivet 9, and more specifically the drive rivet guide shoulder 66 and drives the glide 2. (FIG. 23.)

70. Sensor retention plate collar—fits into the mount plate sensor retention plate bore 71 to locate the sensor retention plate 19 and transfer bearing load from the torque wheel 4 through the torque wheel pivot guide shaft 37 and the torque wheel pivot guide bore 64. (FIG. 23.)

71. Mount plate sensor retention plate bore—accepts the sensor retention plate collar 70 to locate the sensor retention plate 19 and transfer bearing load from the torque wheel 4 through the torque wheel pivot guide shaft 37 and the torque wheel pivot guide bore 64. (FIG. 23.)

72. Pivot rivet pivot hole—accepts the pivot rivet pivot shoulder 59 to allow rotational movement between the mount plate 1, the glide 2, and the pivot plate 3. (FIG. 23.)

73. Cover hold down surface—holds the torque wheel 4 and drive link 7 in place by maintaining contact with the drive pin hold down surface 80 and the drive link hold down surface 79. (FIG. 25.)

74. Hoop strike mounting hole—accepts the strike mount screw 15 to attach the hoop strike 6 to the pivot plate 3. (FIG. 25.)

75. Cover screw mounting holes—accepts the cover screws 11, 12 to attach the cover 17 to the mount plate 1. (FIG. 25.)

76. Pivot plate clearance cutout—allows for cinching door mechanism mount screw to stand proud of the mount plate 1 and not interfere with the pivot plate 3 movement. (FIGS. 23 and 25.)

77. Rear sensor retention plate motor mounting surface—provides a bearing clamp surface for the motor mounting surface 82 to mount the drive motor 10 against. (FIG. 27.)

78. Front sensor retention plate mounting surface—provides a bearing clamp surface for the sensor retention plate 19 to mount to the mount plate 1. (FIG. 23.)

79. Drive link hold down surface—maintains contact with the cover hold down surface 73 to hold the drive link 7 in place. (FIG. 23.)

80. Drive pin hold down surface—maintains contact with the cover hold down surface 73 to hold the torque wheel 4 in place. (FIG. 23.)

81. Glide clearance cutout—allows for cinching door mechanism mount screw to stand proud of the mount plate 1 and not interfere with the glide 2 movement. (FIG. 23.)

82. Motor mounting surface—provides a bearing clamp surface for the sensor retention plate 19 to mount to the motor 10. (FIG. 23.)

83. Strike bolt latch retention surface—a location where the latching device attaches the door to the cinching door mechanism. (FIG. 16.)

Figure 29:
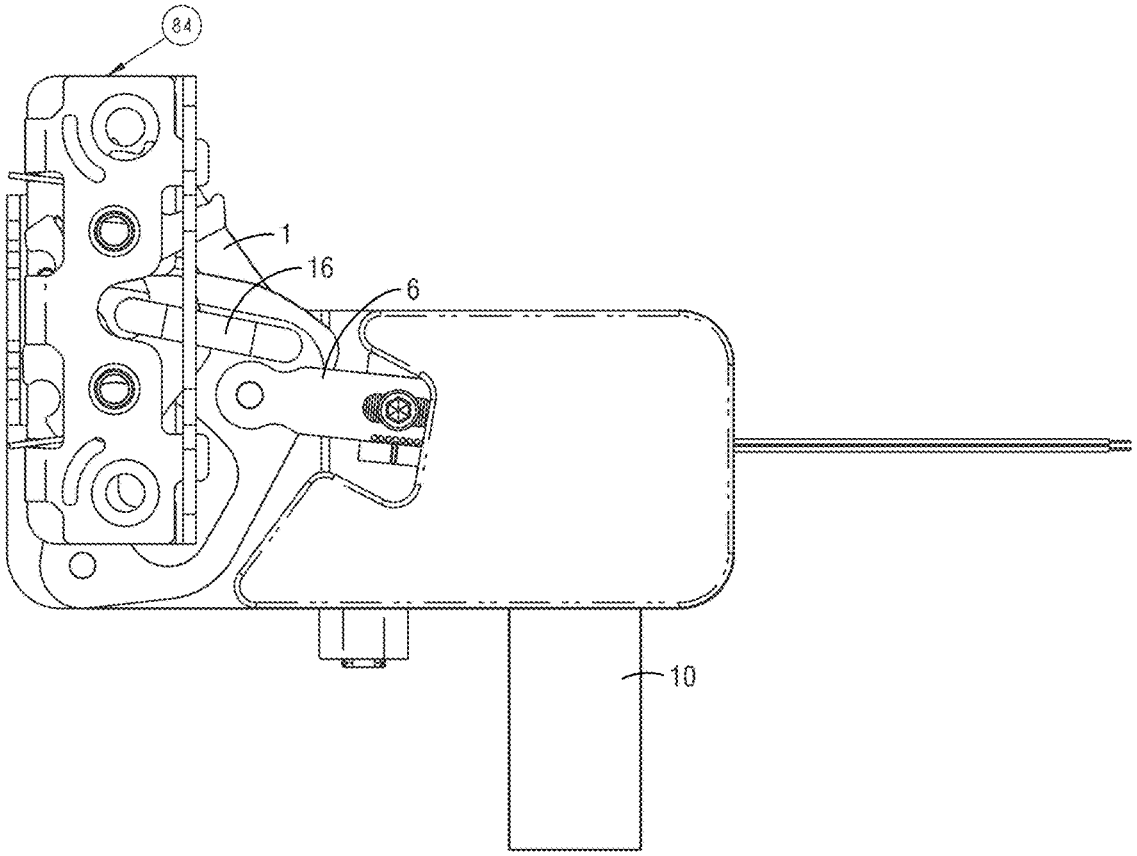
FIG. 29 is a plan view showing the engagement of the rotary latch and the hoop strike.
Figure 30:
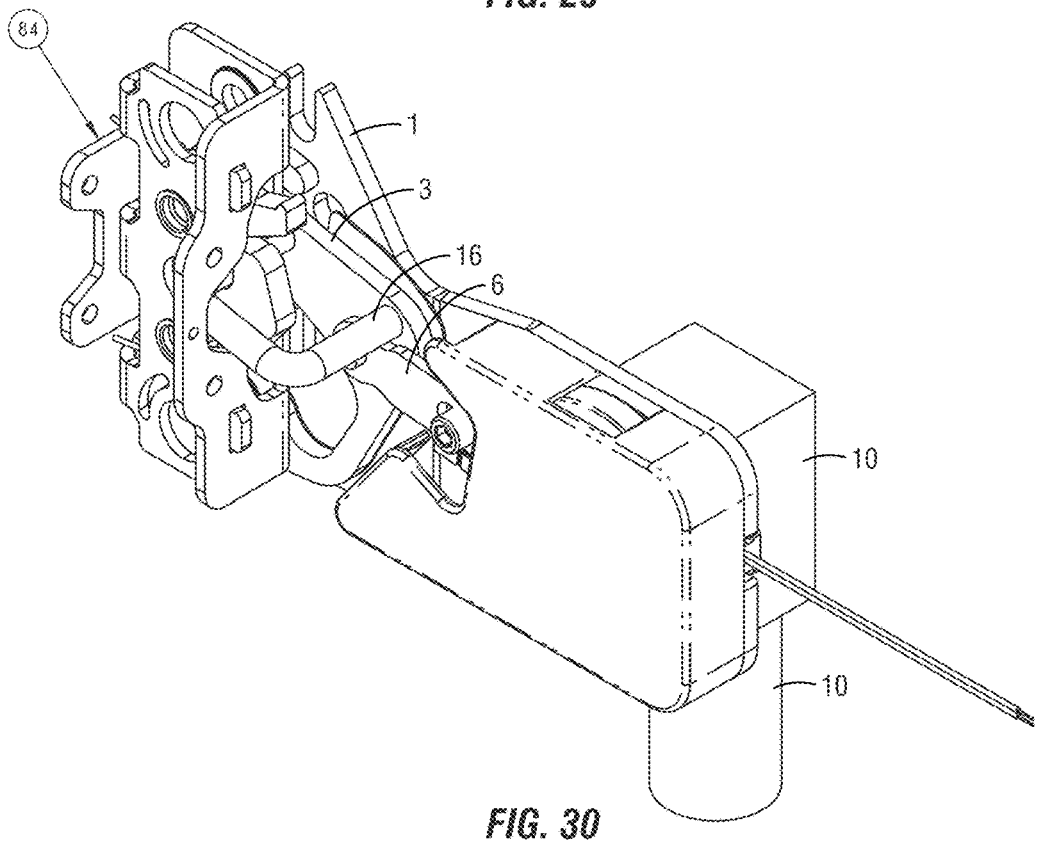
FIG. 30 is a perspective view of FIG. 29 showing the engagement of the rotary latch and the hoop strike.
Figure 31:
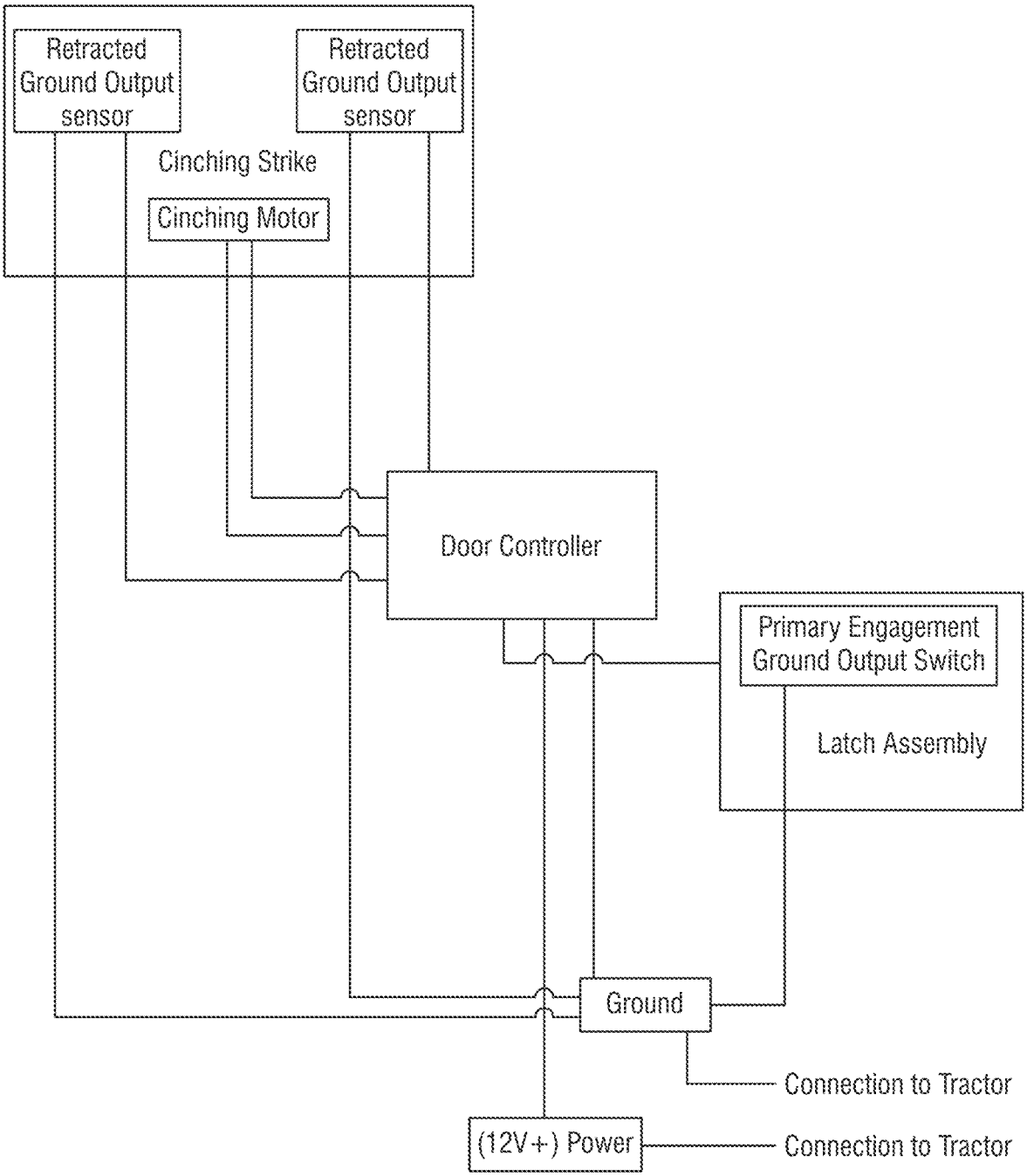
FIG. 31 is a schematic view of the strike and the latch assembly controller.
Figure 32:
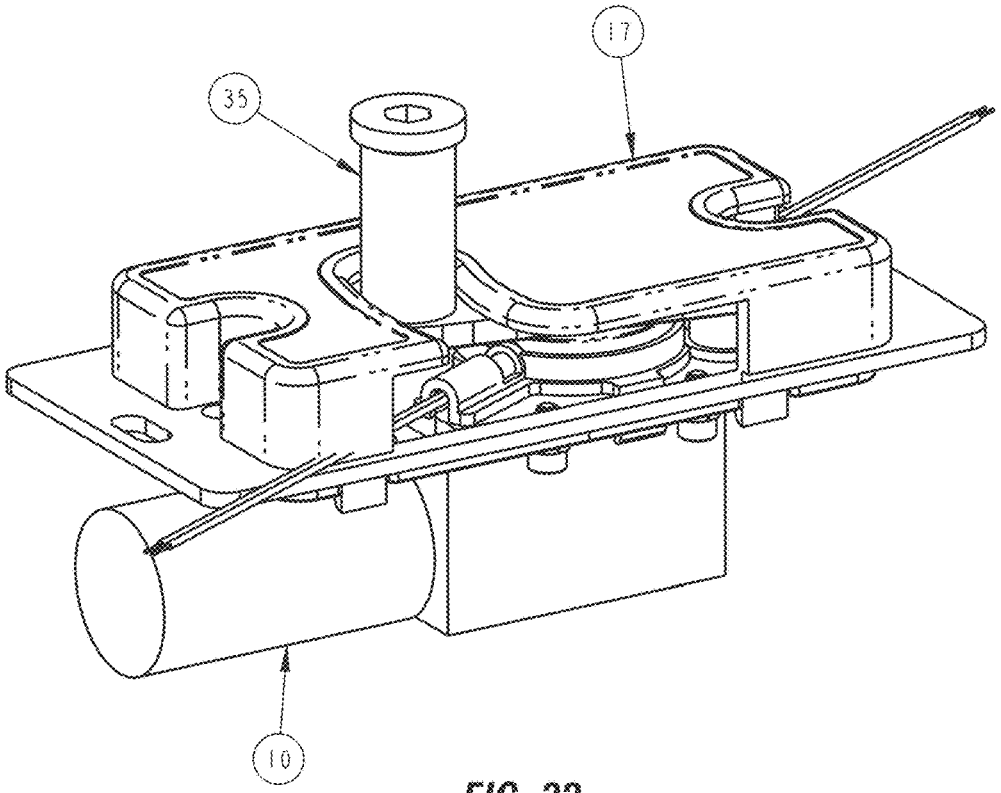
FIG. 32 is a perspective view of another alternative embodiment that has motor directly placed under the mechanical assembly with strike bolt shown in retracted position.
Figure 33:
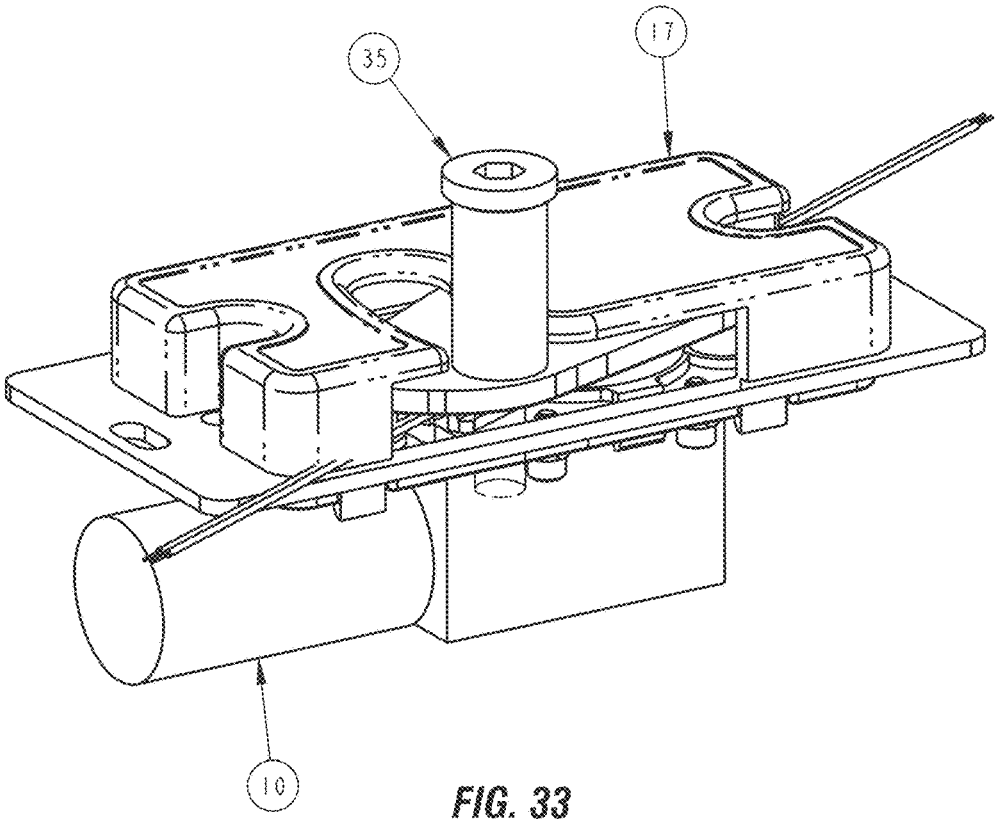
FIG. 33 is a perspective view of alternative embodiment of FIG. 32 with strike bolt shown in extended position.
Figure 34:
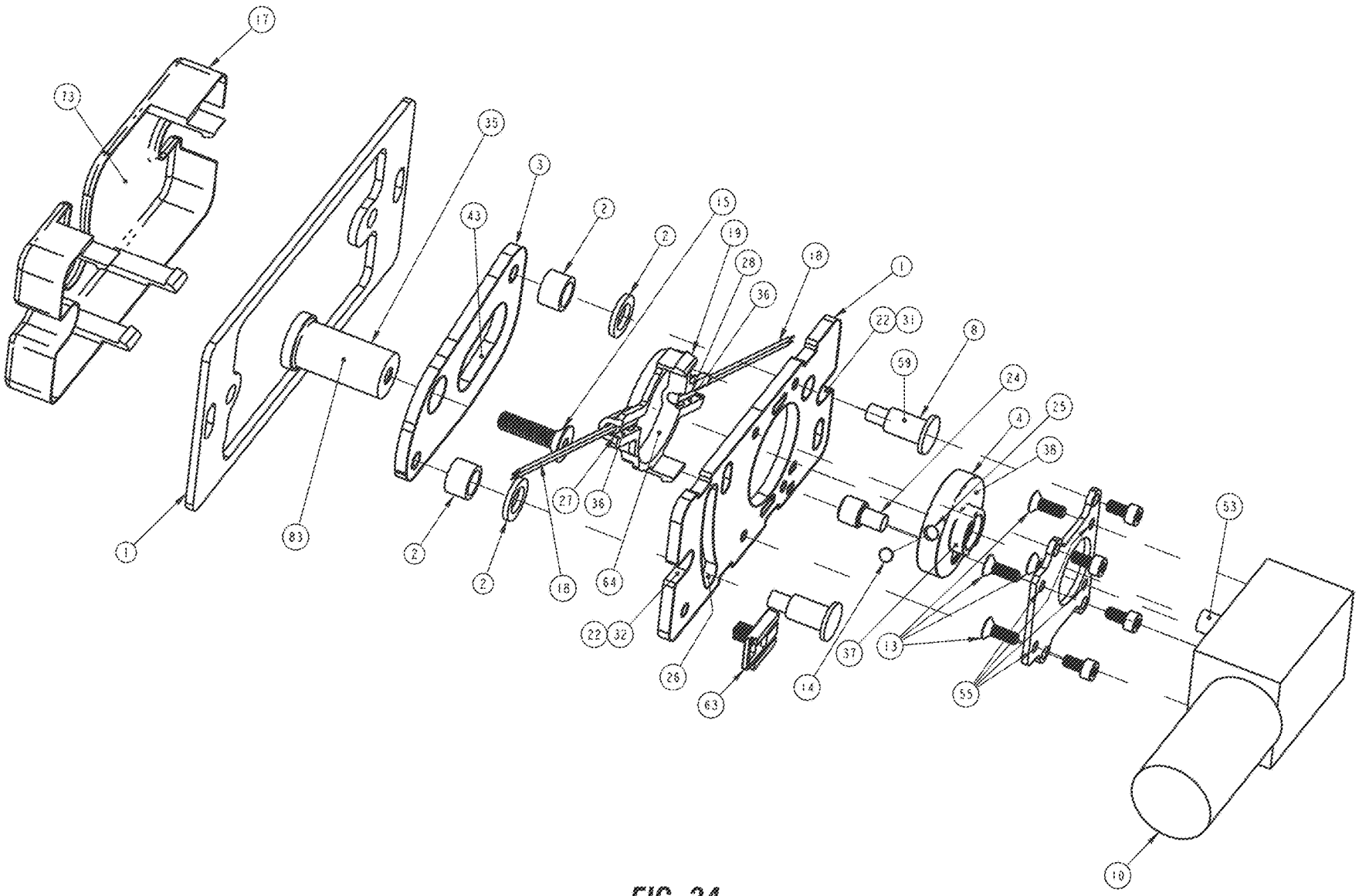
FIG. 34 is a rear perspective of alternative embodiment of FIG. 32 shown exploded.
Figure 35:
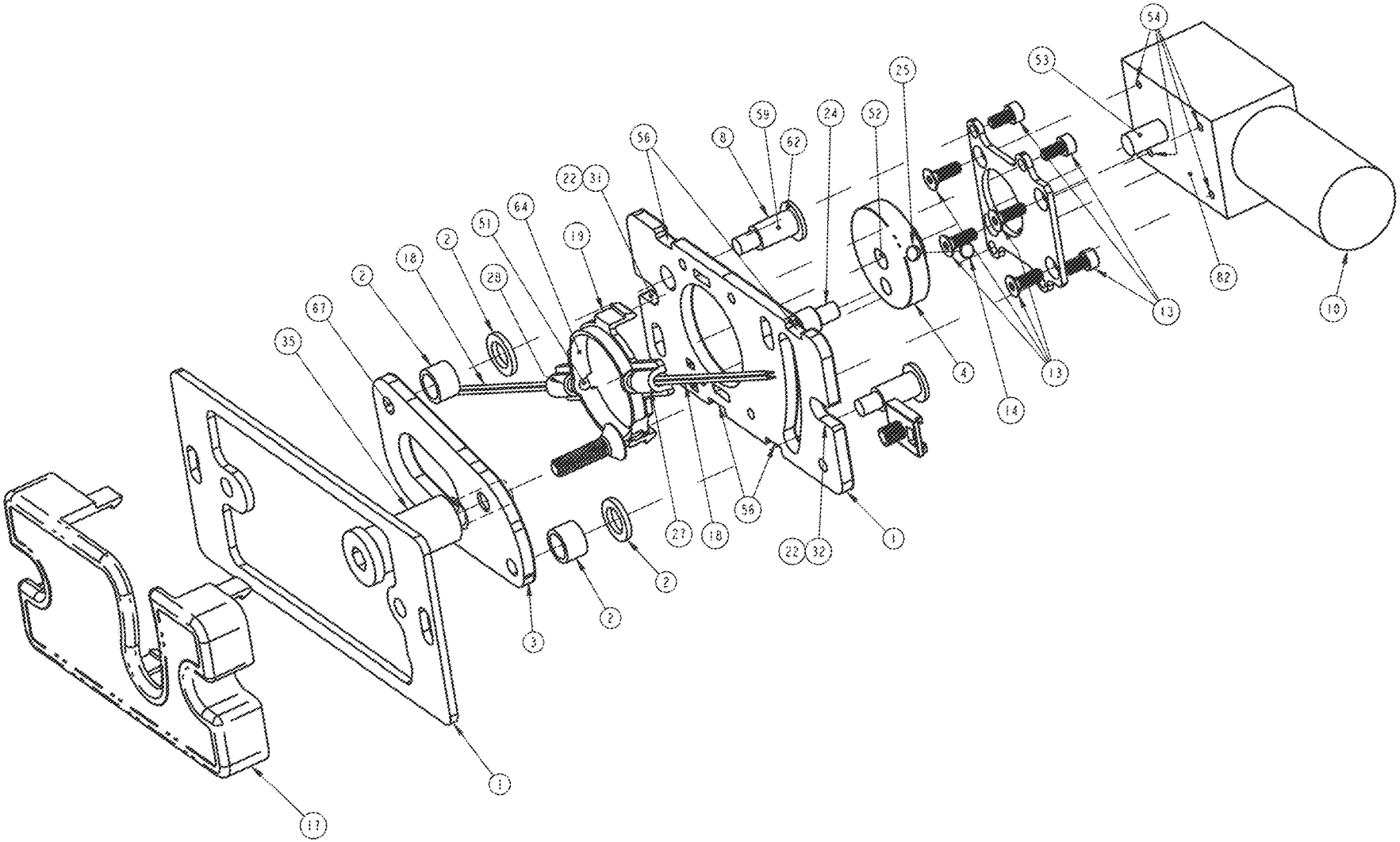
FIG. 35 is a front perspective of alternative embodiment of FIG. 32 shown exploded.
Figure 36:
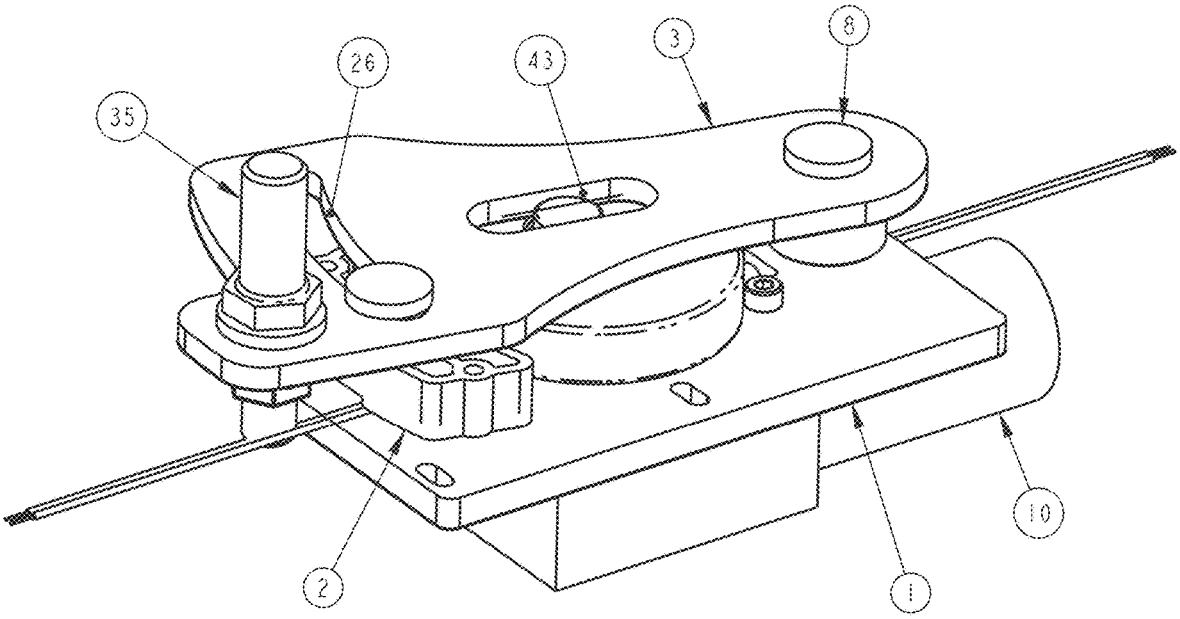
FIG. 36 is a perspective view of yet another alternative embodiment shown with strike in retracted position.
Figure 37:
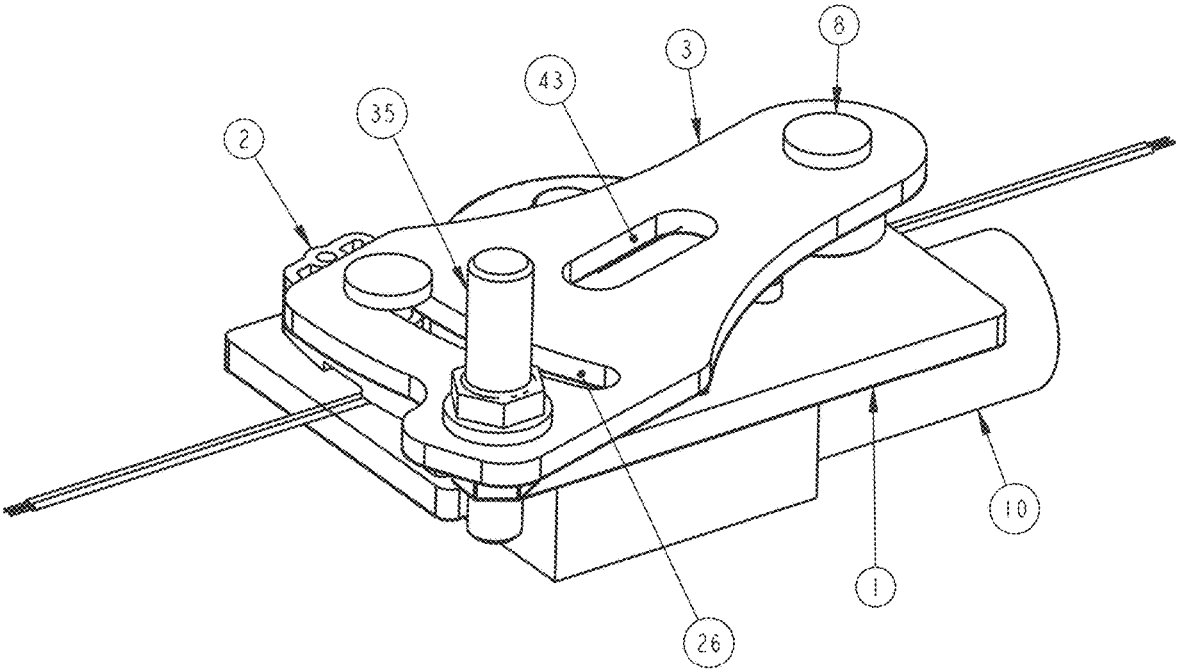
FIG. 37 is a perspective of alternative embodiment of FIG. 36 shown in extended position.

84. Latch—latching mechanism which interfaces with the hoop strike latch retention surface 39 to hold the door in place with respect to the hoop strike 16 and the pivot plate 3 movement. (FIGS. 29 and 30.)

85. Pivot rivet mount shoulder—Fits into the pivot rivet mounting hole 67 to locate and retain the pivot plate 3 and the glide 2 to the mount plate 1. (FIG. 23.)

86. Drive rivet mount shoulder—Fits into the driven link mounting hole 49 to locate and maintain the pivot plate 3, the glide 2, and the mount plate 1 contact, and to drive the pivot plate 3 and the glide 2. (FIG. 23.)

87. Longitudinal loading rivet mount shoulder—Fits into the longitudinal load rivet mounting hole 65 to retain the longitudinal loading rivet 29 to the mount plate 1. (FIGS. 23.)

88. Latch switch—provides feedback to the controller that the latch is in the primary and fully latched position and in the unlatched and fully open position.

In operation, the strike of the embodiment shown in FIGS. 1-31 is in an extended position when the door is open and the latch is disengaged or open. When the door is closed, the latch engages the strike, which is detected by the switch, which in turn sends a signal to the controller to actuate the motor. The motor rotates the torque wheel, which in turn moves the drive link and driven link, so as to pivot the pivot plate and thereby retract the strike approximately 1". This retraction movement of the strike pulls the door tight to provide an enhanced seal between the door and the door frame. When the latch is released or disengaged from the strike by operation of the interior or exterior door handle to open the door, the switch in the rotary latch sends a signal to the controller to actuate the motor, which in turn rotates the torque wheel which moves the drive link and driven link, so as to pivot the pivot plate and thereby extend the strike approximately 1", in preparation for the next closing of the door.

The torque wheel can be rotated 360° by the motor, or in the case of a reciprocating motor the torque wheel is oscillated 180°, so as to extend and retract the strike.

As seen in FIGS. 10-15, the start and end positions of the hoop and/or bolt strike can be adjusted or fine-tuned by changing the extent of overlap between the drive link 7 and the driven link 6. The links 6, 7 have overlapping teeth 46, 47 to secure the links in a desired extended or retracted position via the link adjustment screw 5.

The motor 10 is connected to a power supply of the vehicle independently of the rotary latch. Therefore, in case of a power failure, the latch can still be operated in a normal manner to open and close the vehicle door. Thus, a person cannot be locked in or locked out of the vehicle due to a lack of power to the motor, such as a dead battery.

In the alternative embodiment shown is FIGS. 4-9, if the strike and latch assembly is subjected to longitudinal loading, the retention of the loading rivet 29 in the slot 30 of the pivot plate 3 facilitates retention of the pivot plate to the mount plate 1.

The alternative embodiment shown in FIGS. 32-37 is a compact design that uses a motorized wheeled pin to move a strike bolt between door open and door closed positions. When the latch is closed on the strike, the wheeled pin moves the strike bolt between door open and door closed positions. When the latch is closed on the strike, the wheeled pin then pulls the strike into the door closed position. On release of the latch, the wheeled pin returns the strike to the door open position. Assembly allows adjustment for alignment of the body-mounted strike with the door-mounted latch jaws.

When compared to the embodiments of FIGS. 1-30, the compact design reduces the space claim for the cinching mechanism by over 50% while increasing available strike travel by 25%. The compact design also adds separate vertical and horizontal adjustability of the strike relative to the door structure of the vehicle.

For this compact embodiment, the key components, and functions are as follows.

1. Mount plate—provides mounting surfaces for all cinching mechanism parts and provides mounting and mounting adjustment details for mounting to the vehicle.

2. Glide—isolates the moveable pivot plate 3 from the mounting plate 1 to reduce friction and wear.

3. Pivot Plate—provides a base with a mounting surface for moveable apparatus, also has a pivot rivet mounting hole 67, and a pivot plate drive hole 58.

4. Torque Wheel—houses a magnet 14 for positional sensing, provides a drive feature for motor interface, and drive feature for link that connects torque wheel to pivot plate.

8. Pivot Rivet—retains the pivot plate 3 and the glide 2 to the mount plate 1, and allows the pivot plate 3 and the glide 2 to pivot via the pivot rivet pivot shoulder 59.

10. Drive Motor—provides rotational motion and torque to the torque wheel 4 to drive the mechanism. The motor is electric, and preferably rotates 360°, though a reversible motor can also be used.

13. Motor Mount Screw—retains the sensor retention plate 19 and the drive motor 10 to the mount plate 1.

14. Magnet—provides a magnetic field to be sensed by the extended/retracted position sensor.

15. Strike mount screw—retains the strike apparatus 16 to the pivot plate 3.

17. Cover—covers all moveable part and retains the drive link 7 and the torque wheel 4 and maintains their contact.

18. Extended/Retracted Position Sensor—provides positional feedback by sensing the magnet 14 and opening or closing a circuit internal to itself that a cinching strike controller input can verify.

19. Sensor Retention Plate—provides for positive positional placement of the extended/retracted sensor 18, provides wire routing features, and location for a wire retaining zip tie 20 to be secured.

22. Vertical adjustment slots—on the mount plate 1 and allows for the cinching door mechanism to be adjusted vertically on a vehicle mounting location. (FIG. 2)

24. Torque wheel drive pin—mates with the drive link drive hole 50 to provide a place for an interface to the drive link land the torque wheel 4 (FIG. 23).

25. Magnet pocket—provides a place for the magnet 14 to be attached to the torque wheel 4 (FIG. 3).

26. Arcuate Drive Rivet Slot—in the mount plate 1 to provide sliding guide for the drive rivet 9 to pass through the mount plate 1, thus allowing the drive rivet head to be on the back side of the mount plate 1 so as to retain the pivot plate 3 and the glide 2 to the mount plate 1 (FIG. 3).

27. Retracted Sensor Position—senses the magnet 14 to tell the cinching door mechanism controller to stop motion that mechanism is retracted (FIG. 3).

28. Extended Sensor Position—senses the magnet 14 to tell the cinching door mechanism controller to stop motion that mechanism is extended (FIG. 3).

29. Longitudinal loading rivet—retains an upper part of the pivot plate 3 to the mount plate 1 when longitudinal load is placed on the strike device 16, 35. (FIGS. 5 and 7.)

30. Longitudinal loading slot—in the pivot plate 3 to provide a place for interface of the pivot plate 3 to the longitudinal loading rivet 29. (FIGS. 4 and 7).

31. Lower vertical adjustment slot—one of the slots 22 in the mount plate 1 to provide interface for the mounting fastener, and to allow for vertical adjustment of the cinching mechanism. (FIGS. 10 and 20.)

32. Upper vertical adjustment slot—one of the slots 22 in the mount plate 1, to provide interface for mounting the fastener, and to allow for vertical adjustment of the cinching mechanism. (FIGS. 10 and 20.)

36. Sensor retention plate pocket—U-shaped channel in the sensor retention plate 19 that accepts the extended sensor 28 and retracted sensor 27. (FIG. 27.)

38. Torque wheel bearing surface—provides a bearing surface for the torque wheel 4 to rest against the mount plate 1. (FIG. 25.)

39. Hoop strike latch retention surface—location where latching the device attaches the door to the cinching door mechanism. (FIG. 23.)

43. Drive rivet retention slot—slot that controls the drive rivet 9 and allows for the drive rivet 9 to move the pivot plate 3 on the mount plate 1. (FIGS. 20 and 23.)

51. Sensor Face—Face of the extended/retracted sensor 18 that is oriented near the magnet 14 to sense the magnetic field. (FIG. 27.)

52. Torque wheel center drive—receives the motor drive shaft 53 to transfer rotation and torque to the torque wheel 4. (FIG. 25.)

53. Motor drive shaft—transfers rotation and torque from the drive motor 10 to the torque wheel 4 to drive the cinching door mechanism. (FIG. 23.)

54. Motor mounting holes—threaded holes that allow for the motor mount screw 13 to be threaded into the motor 10. (FIG. 23.)

55. Motor mounting holes—clearance hole in the mount plate 1 that allow for the motor mount screw 13 to pass through and align the drive motor 10 to the mount plate 1, also retains the drive motor 10 so it can pass rotation and torque to the torque wheel 4. (FIG. 23.)

56. Cover mounting holes—holes in the mount plate 1 that accept the cover screw 11, 12. (FIG. 23.)

57. Strike mounting holes—holes in the pivot plate 3 that allow the strike mount screw 15 to pass through and attach the strike apparatus 16, 35. (FIG. 23.)

59. Pivot rivet pivot shoulder—fits into the pivot rivet pivot hole 72 and allows rotational motion between the mount plate 1, the pivot plate 3, and the glide 2. (FIG. 23.)

62. Pivot rivet retention head—maintains contact with the mount plate surface to retain contact of the mount plate 1, the glide 2, and the pivot plate 3. (FIG. 23.)

63. Wire routing retention zip tie mounting holes—access holes in the sensor retention plate 19 that allow the wire retaining zip tie 20 to be looped through to retain wires. (FIG. 3.)

64. Torque wheel pivot guide bore—accepts the torque wheel pivot guide shaft 37 to provide a bearing surface for side load of the torque wheel 4. (FIG. 27.)

67. Pivot rivet mounting hole—accepts the pivot rivet mount shoulder 85 and affixes the pivot rivet 8 to the pivot plate 3. (FIG. 23.)

70. Sensor retention plate collar—fits into the mount plate sensor retention plate bore 71 to locate the sensor retention plate 19 and transfer bearing load from the torque wheel 4 through the torque wheel pivot guide shaft 37 and the torque wheel pivot guide bore 64. (FIG. 23.)

71. Mount plate sensor retention plate bore—accepts the sensor retention plate collar 70 to locate the sensor retention plate 19 and transfer bearing load from the torque wheel 4 through the torque wheel pivot guide shaft 37 and the torque wheel pivot guide bore 64. (FIG. 23.)

72. Pivot rivet pivot hole—accepts the pivot rivet pivot shoulder 59 to allow rotational movement between the mount plate 1, the glide 2, and the pivot plate 3. (FIG. 23.)

73. Cover hold down surface—holds the torque wheel 4 and drive link 7 in place by maintaining contact with the drive pin hold down surface 80 and the drive link hold down surface 79. (FIG. 25.)

78. Front sensor retention plate mounting surface—provides a bearing clamp surface for the sensor retention plate 19 to mount to the mount plate 1. (FIG. 23.)

80. Drive pin hold down surface—maintains contact with the cover hold down surface 73 to hold the torque wheel 4 in place. (FIG. 23.)

82. Motor mounting surface—provides a bearing clamp surface for the sensor retention plate 19 to mount to the motor 10. (FIG. 23.)

83. Strike bolt latch retention surface—a location where the latching device attaches the door to the cinching door mechanism. (FIG. 16.)

Figure 38:
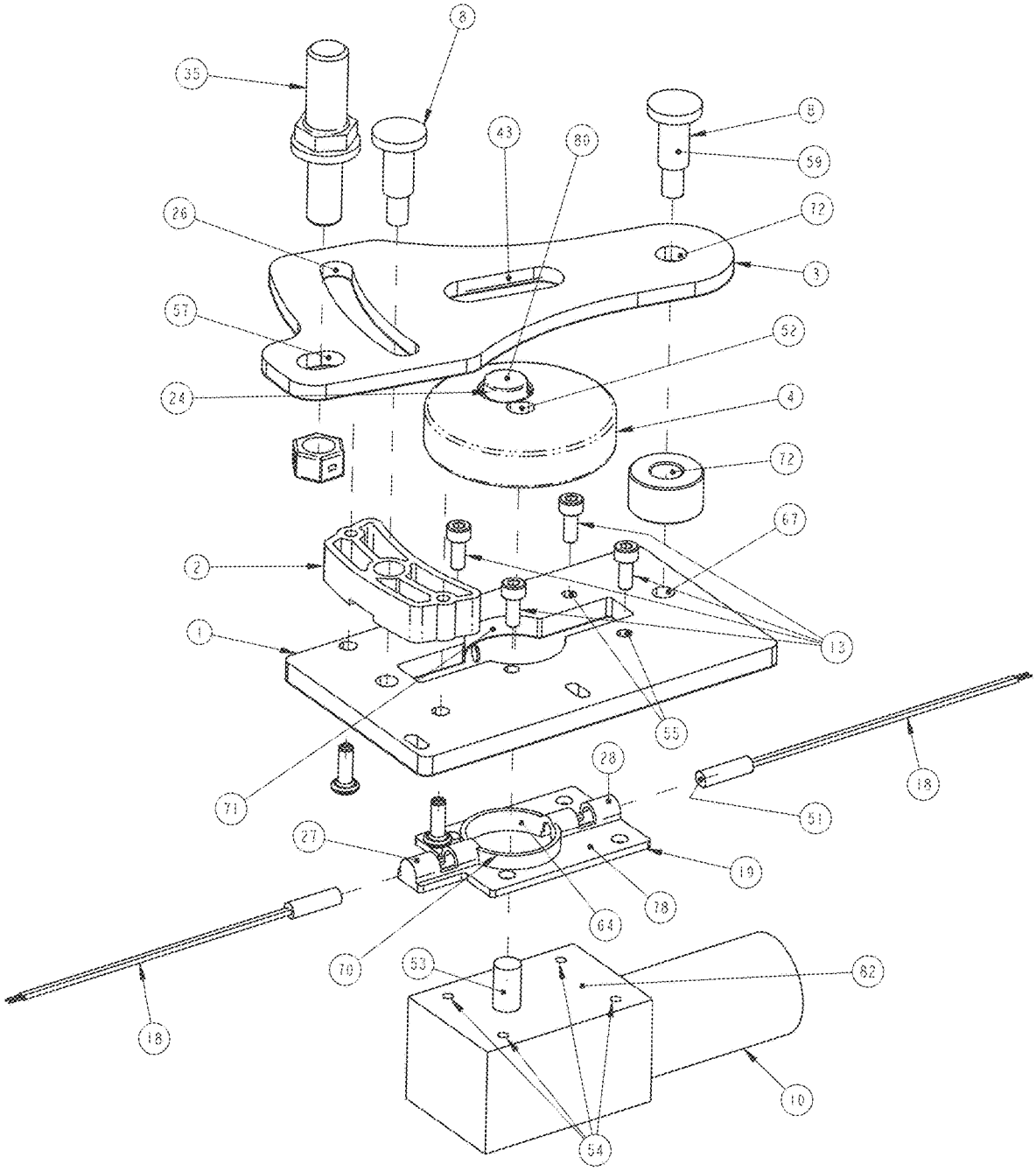
FIG. 38 is a perspective exploded view of the embodiment shown in FIGS. 36 and 37.
Figure 39:
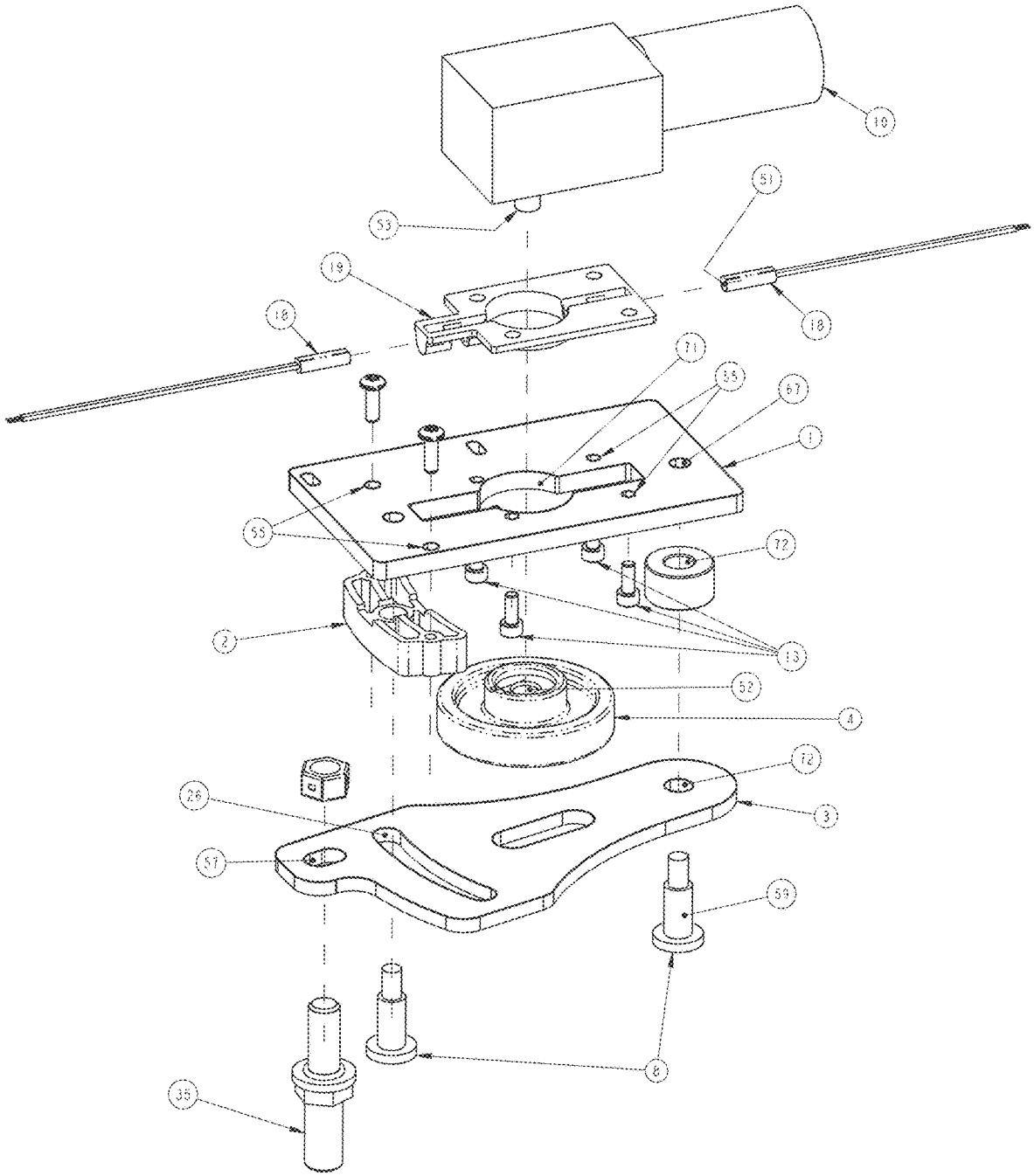
FIG. 39 is another perspective exploded view of the embodiment shown in FIGS. 36 and 37.
Figure 40:
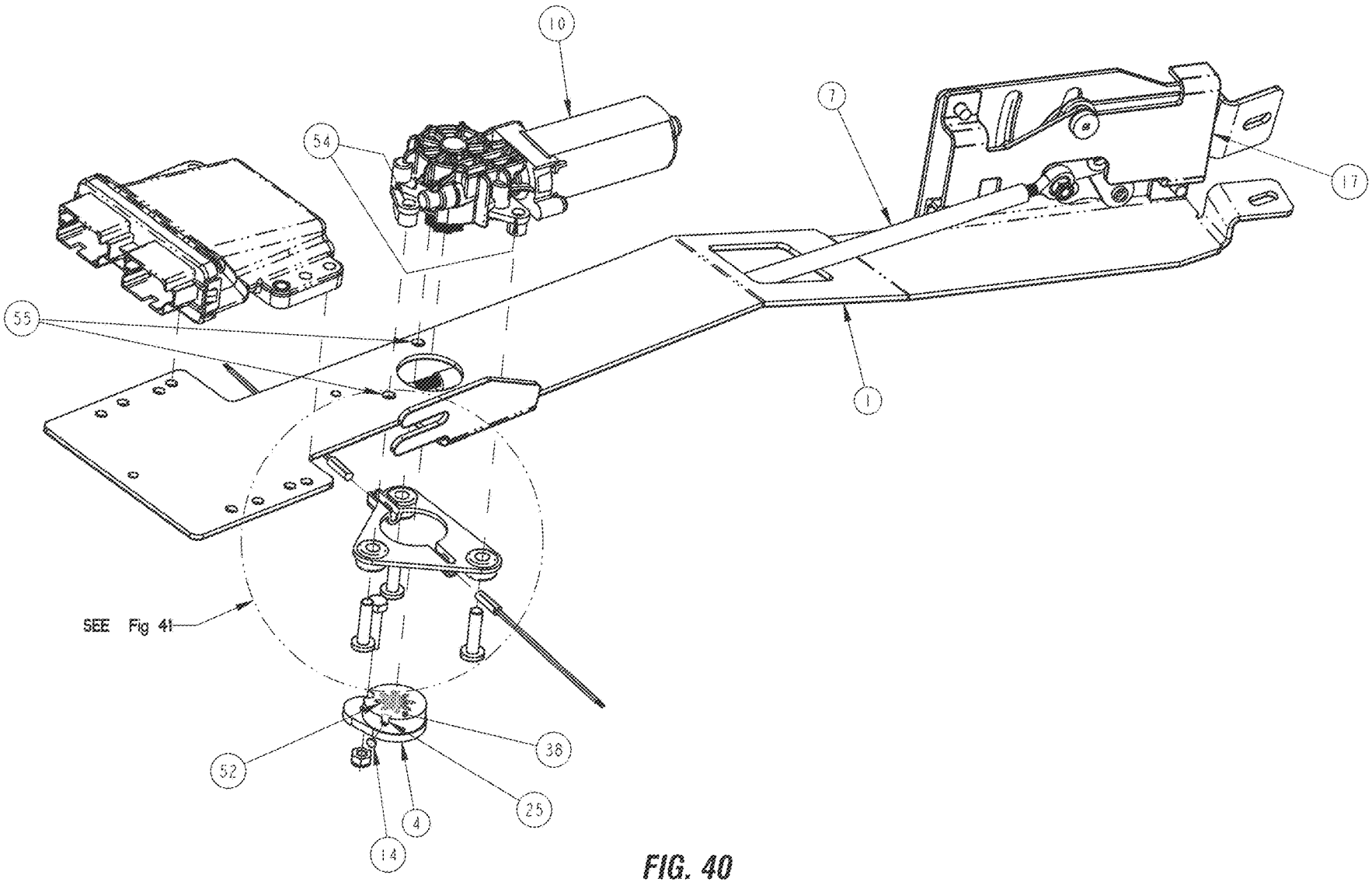
FIG. 40 is an exploded perspective of alternative embodiment of a self-contained assembly module with a remote drive motor and controller.
Figure 41:
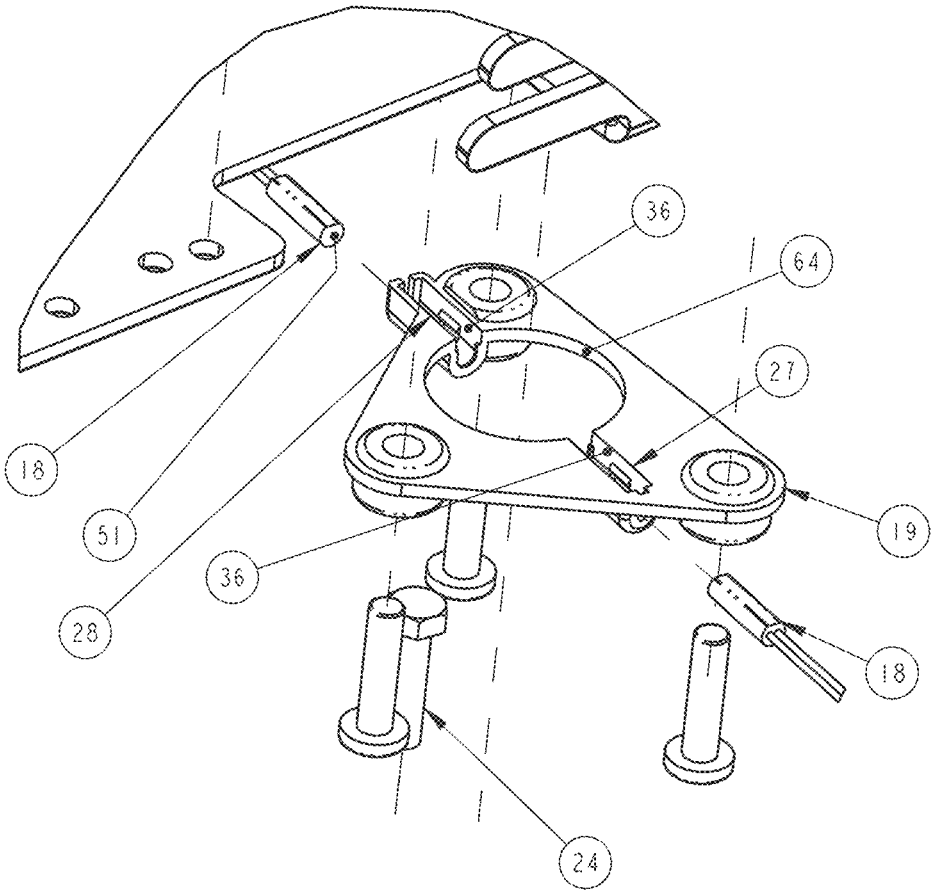
FIG. 41 is an enlarged view taken along line 41 of FIG. 40.
Figure 42:
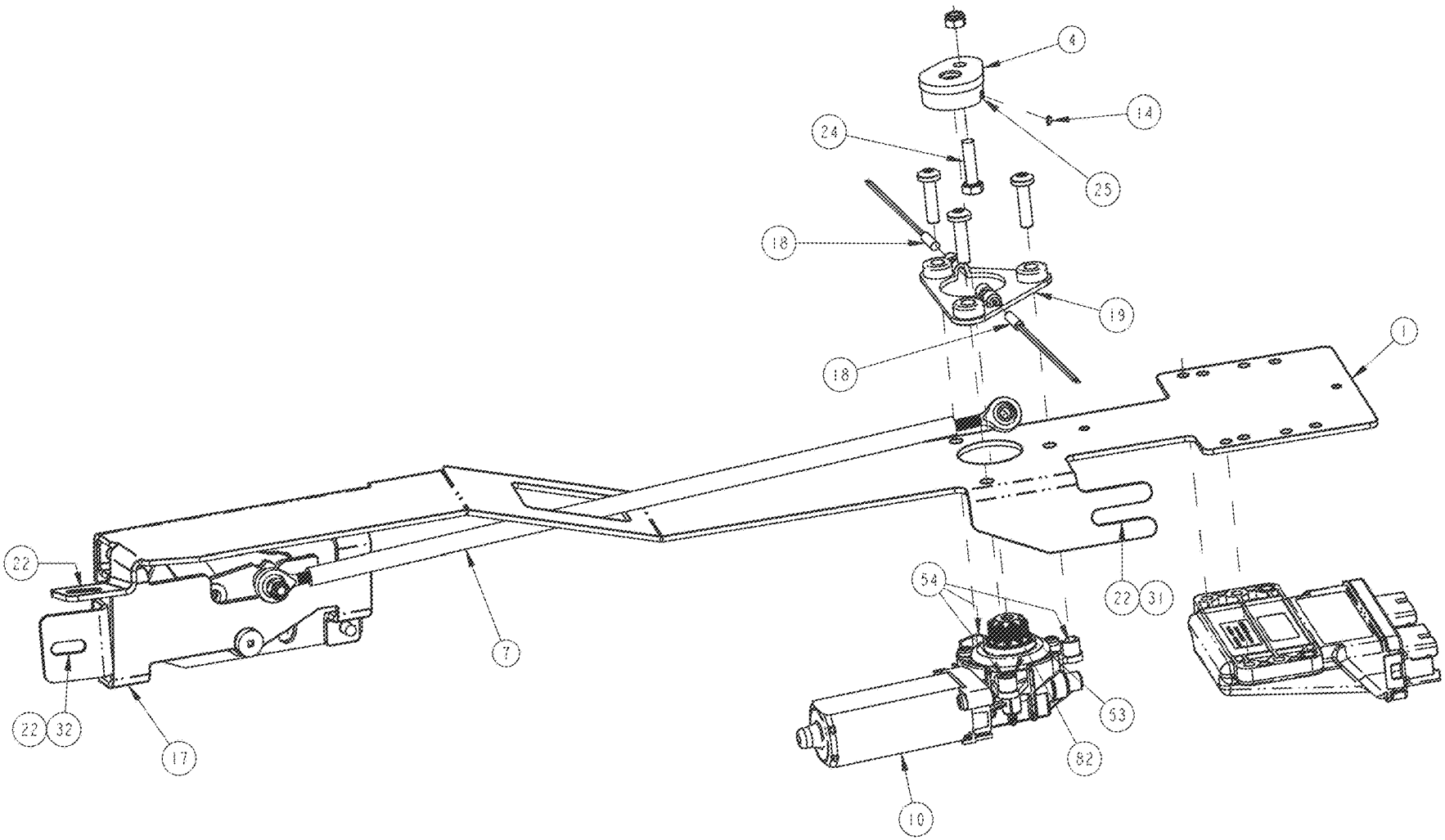
FIG. 42 is an opposite perspective exploded view of the embodiment shown in FIG. 40.
Figure 43:
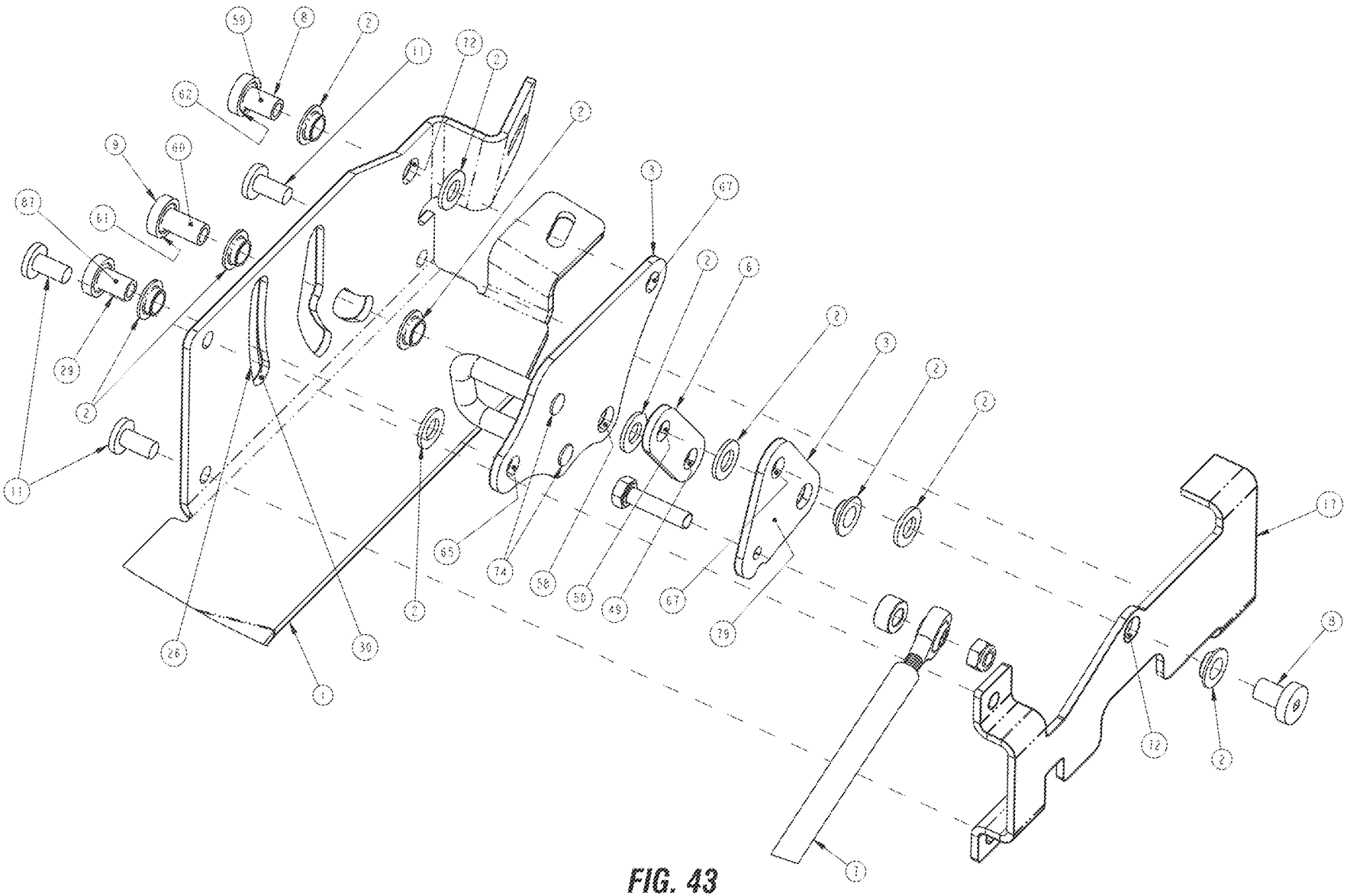
FIG. 43 is an exploded view of the cinching power strike detail of the embodiment of FIGS. 40 and 42, without the full lengths of the mounting plate and connecting rod.
Figure 44:
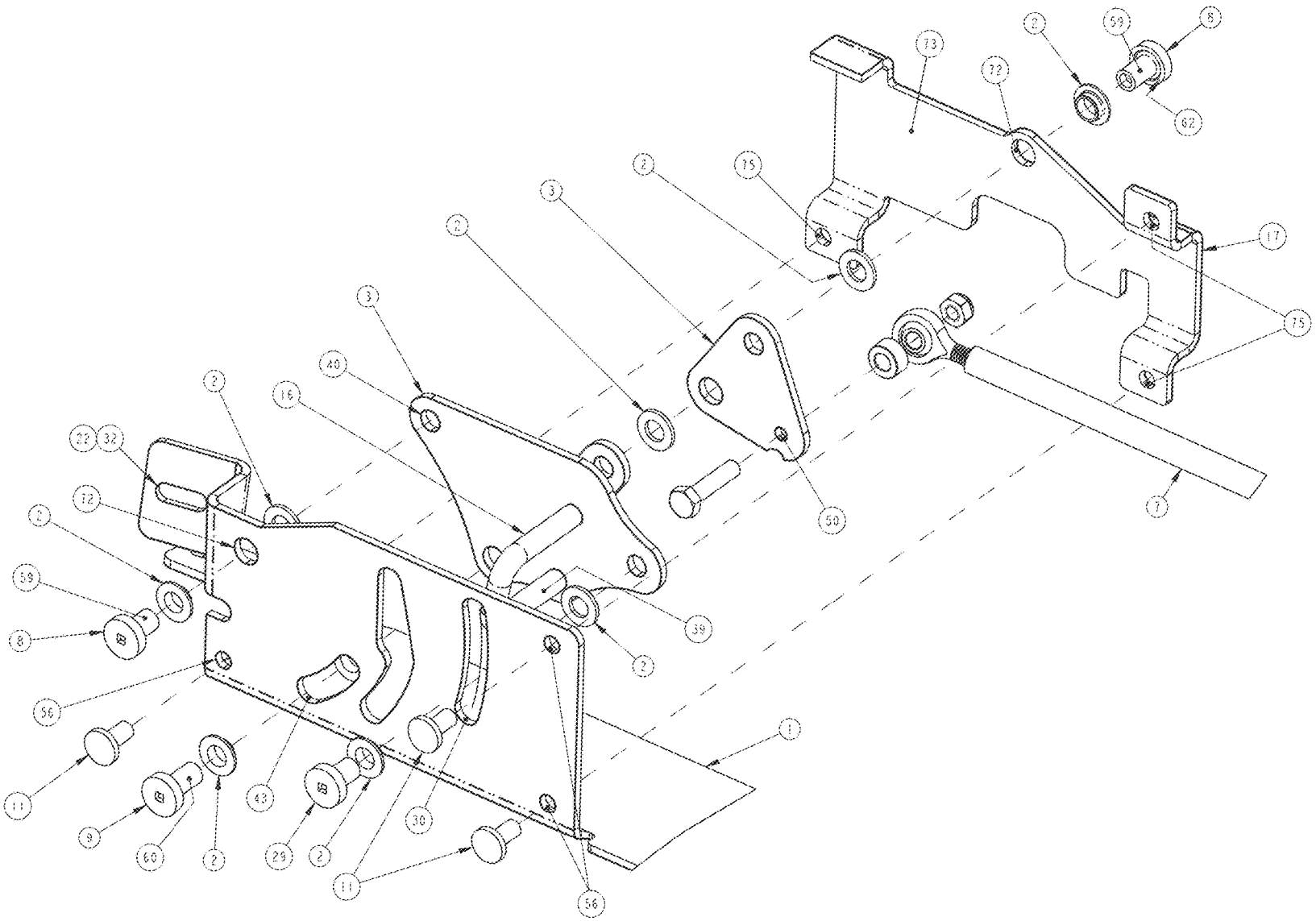
FIG. 44 is an exploded view similar to FIG. 43, from a different perspective.
Figure 45:
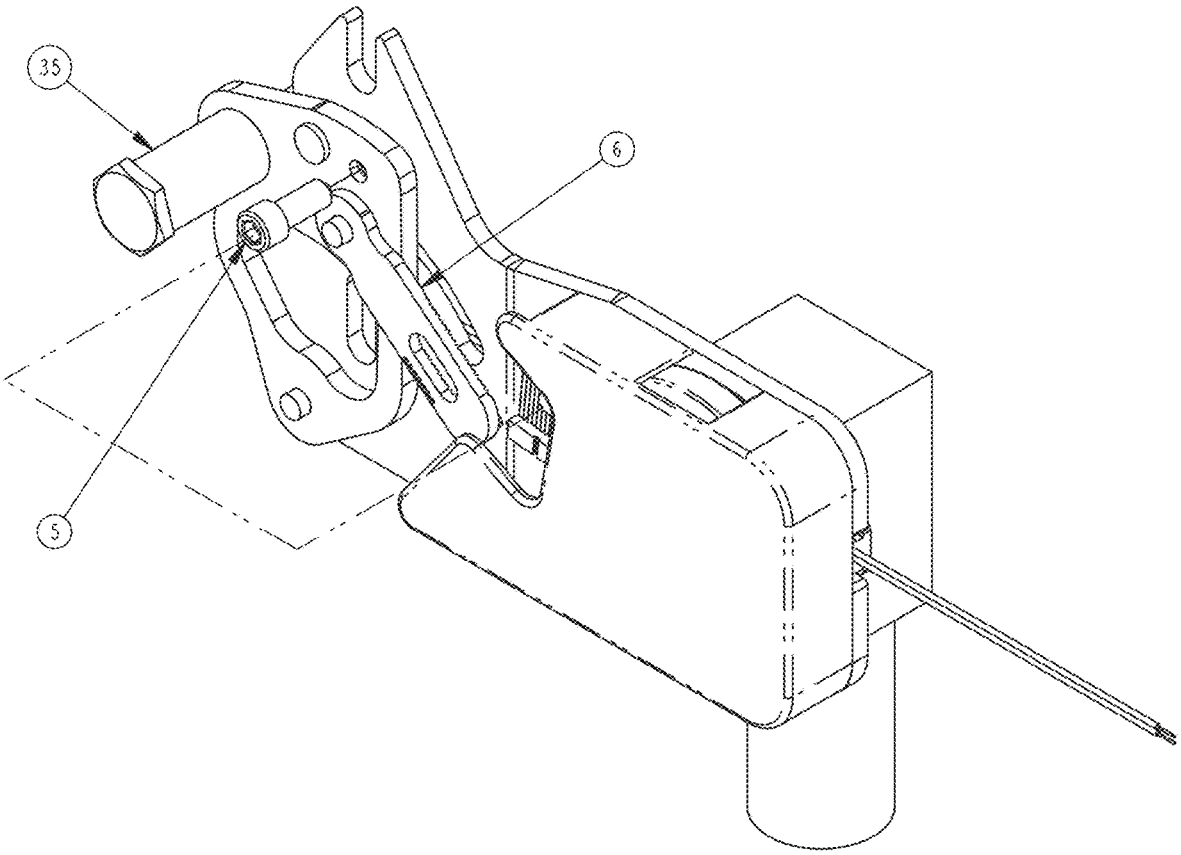
FIG. 45 is a perspective view showing the link adjustment screw removed and mountable into the pivot plate, such that the driven link is disconnected, thereby disabling the power strike function in case of power or motor failure, or other controller or mechanical problems, such that an operator can still open and close the vehicle door with the strike rotated and secured in a retracted position.
Figure 46:
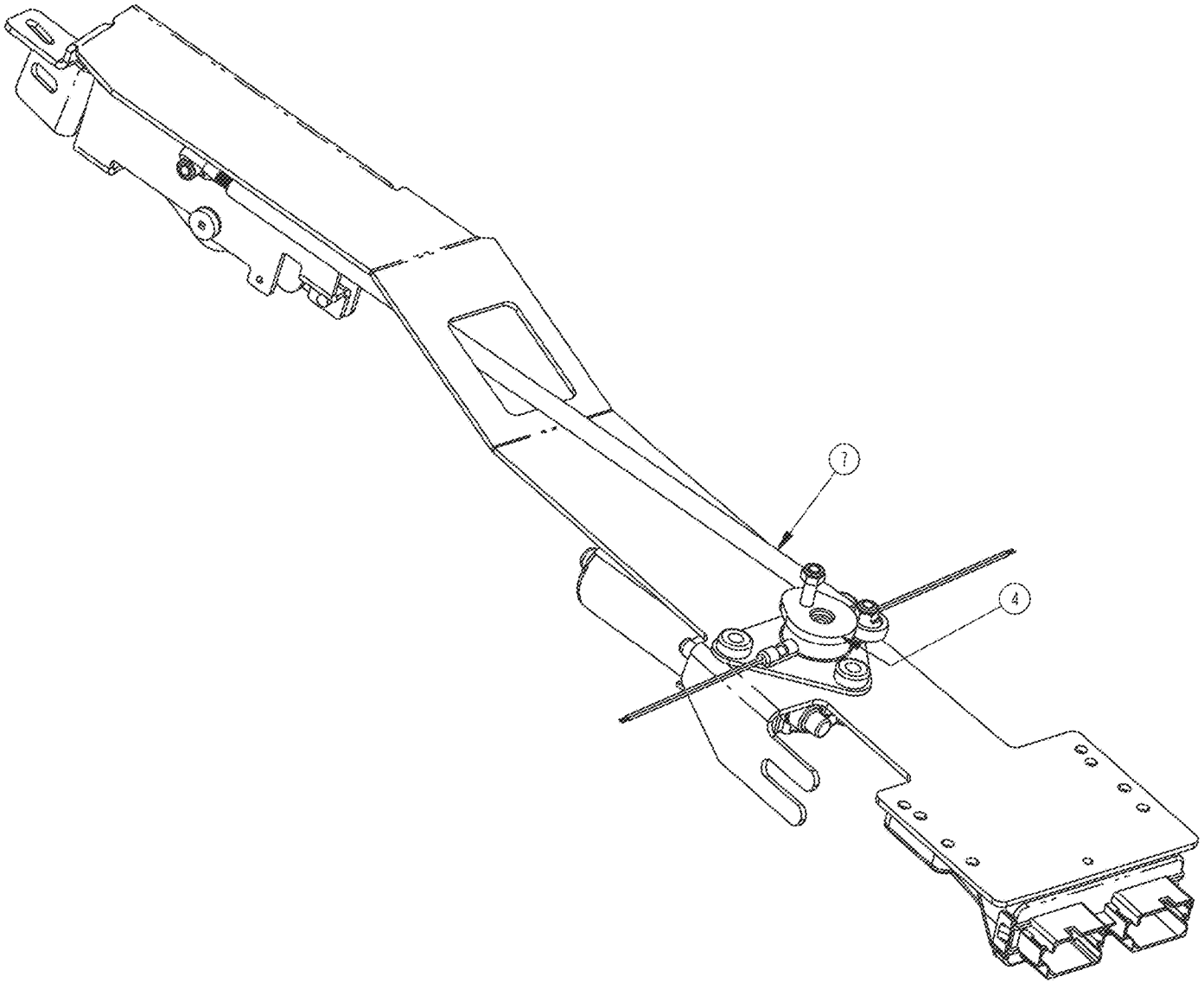
FIG. 46 is a perspective view of the assembly shown in FIG. 40 with the drive link disconnected and secured so as to disable to power of the strike function in the case of motor out of power, controller or other mechanical failure, to allow the operator to still use the vehicle door, with the strike rotated and secured in the retracted position.
Figure 47:
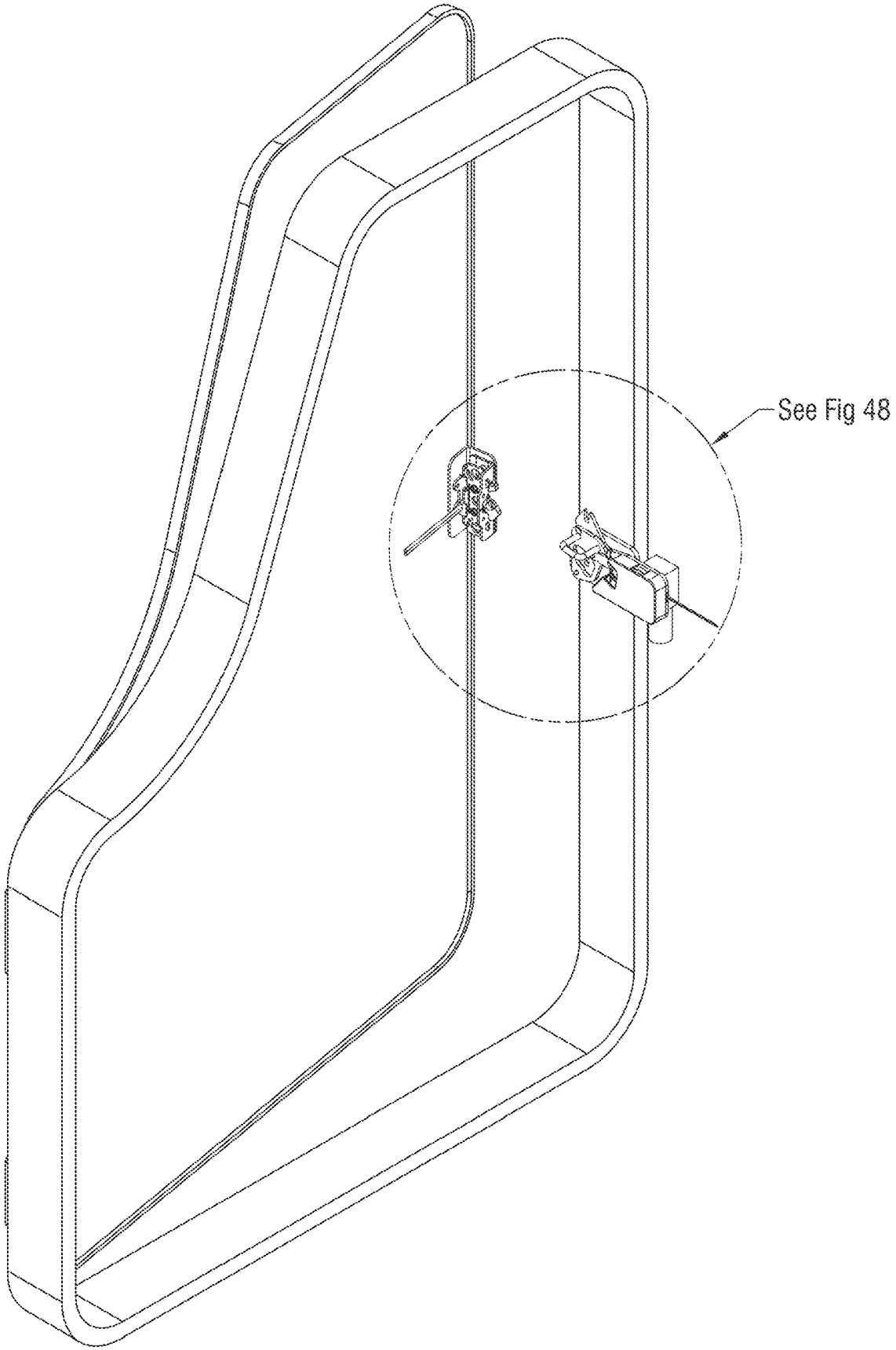
FIG. 47 is a perspective view generally illustrating a vehicle door, such as on an agricultural vehicle, hinged to a door post, with the rotary latch and power strike mounted on the door and the post, respectively.
Figure 48:
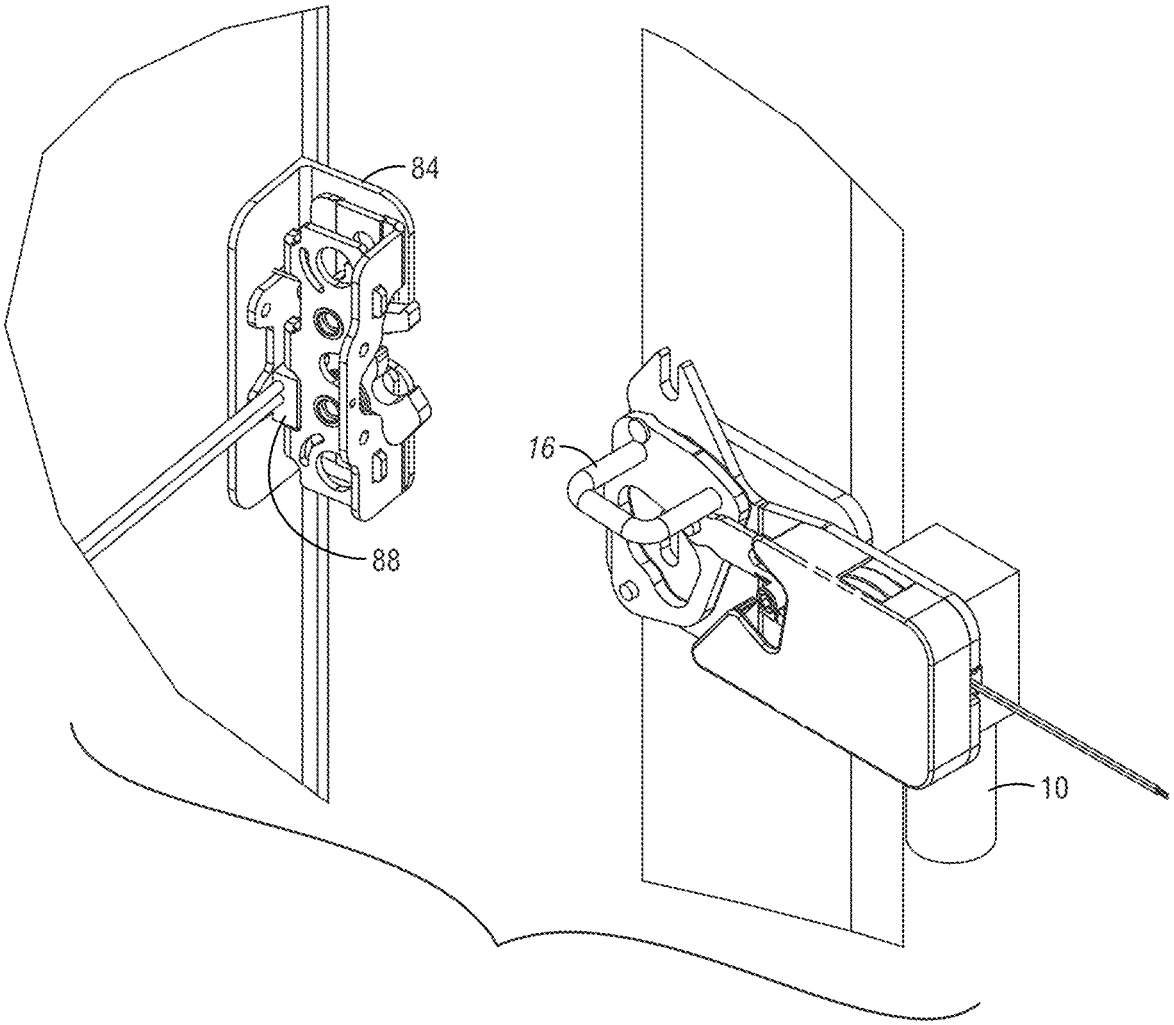
FIG. 48 is an enlarged view taken along line 47 of FIG. 46, with the sensor switch included.
Figure 49:
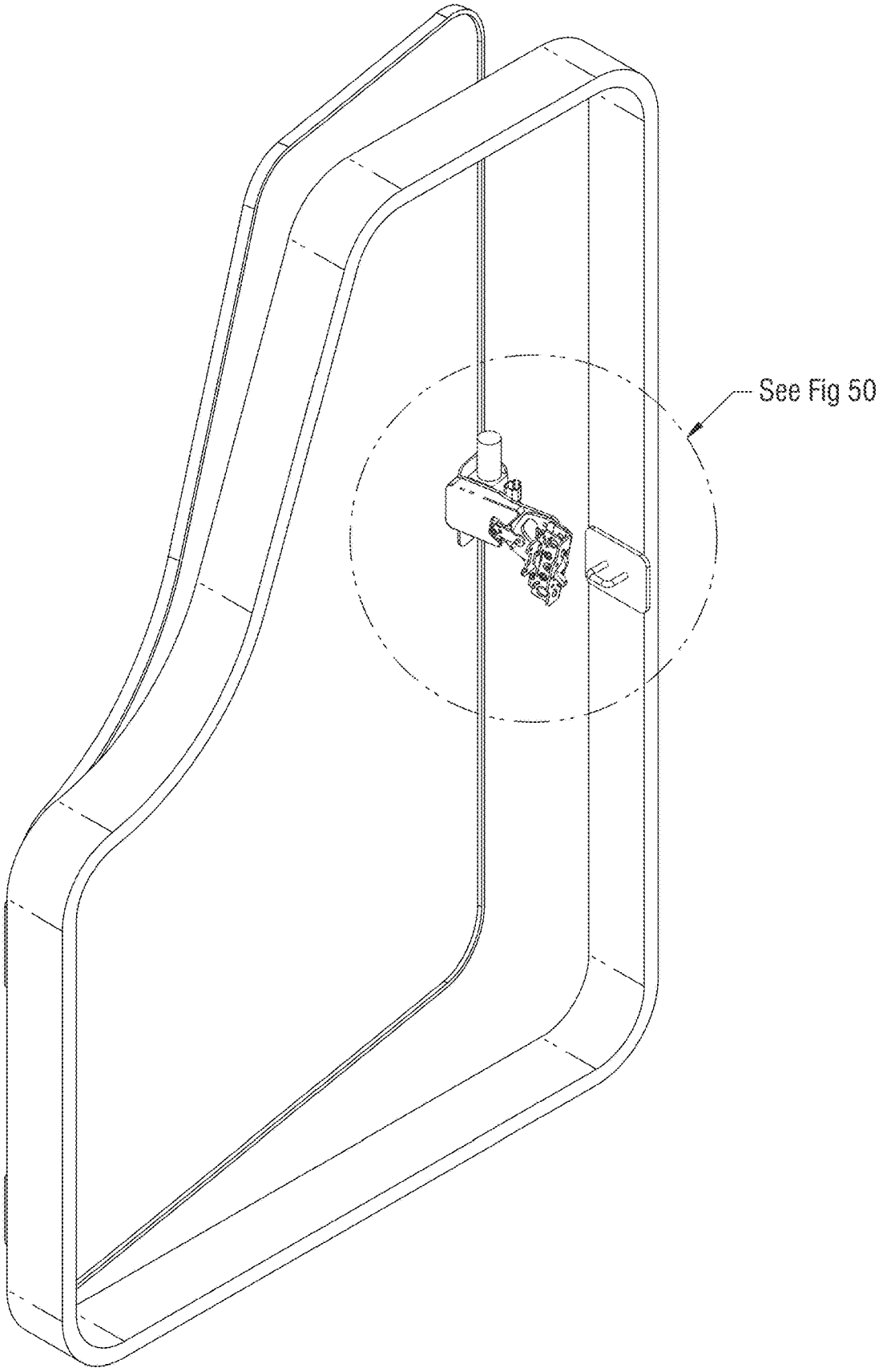
FIG. 49 is a perspective view of a vehicle door, such as on agricultural vehicle, and door post, with an alternative embodiment wherein the powered moveable plate is mounted to the door with the latch assembly, and a fixed strike is mounted on the door post.
Figure 50:
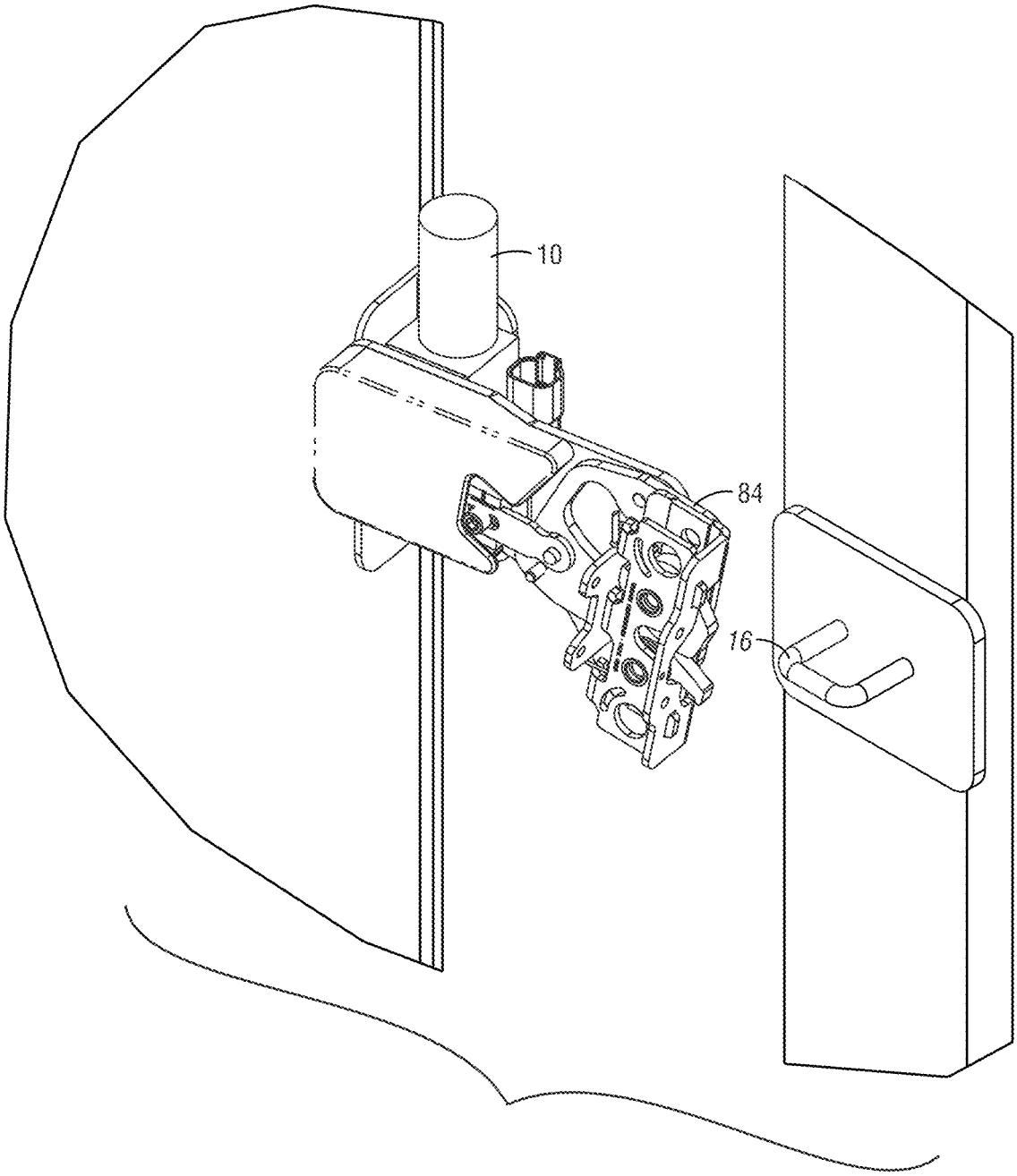
FIG. 50 is an enlarged view taken along line 50 of FIG. 49.

The embodiment shown in FIGS. 38-39 is a way to remotely drive a vehicle door strike with an over center mechanism that is mounted on a mount bracket along with the drive motor, cam, drive rod and controller. The package would contain all items fully assembled and the timing of the cinch mechanism in relationship to the motor and inboard/outboard sensors would be adjusted before being sold to the customer. Customer strike adjustability is built in, but does not affect the operational travel of the motor, cam, sensors, and over center strike mechanism. In the case of an electrical failure there has been a pin provided so that the rod could be disconnected from the cam on the motor and bolted solid to the mount frame to maintain the strike inboard position.

In this embodiment, the primary components and functions are as follows:

1. Mount plate—provides mounting surfaces for all cinching mechanism parts and provides mounting and mounting adjustment details for mounting to the vehicle.

2. Glide—isolates the moveable pivot plate 3 from the mounting plate 1 to reduce friction and wear.

3. Pivot Plate—provides a base with a mounting surface for moveable apparatus, also has a pivot rivet mounting hole 67, and a pivot plate drive hole 58.

4. Torque Wheel—houses a magnet 14 for positional sensing, provides a drive feature for the motor interface, and a drive feature for a link that connects the torque wheel to the pivot plate 3.

6. Driven Link—attaches to the pivot plate 3 via the drive rivet 9 and interfaces with the drive link 7 through the link adjustment screw 5.

7. Drive Link—attaches to the torque wheel 4 via the torque wheel drive pin 24 and interfaces with the driven link 6 through the link adjustment screw 5.

8. Pivot Rivet—retains the pivot plate 3 and the glide 2 to the mount plate 1, and allows the pivot plate 3 and the glide 2 to pivot via the pivot rivet pivot shoulder 59.

9. Drive Rivet—retains the driven link 6 to the pivot plate 3, drives the pivot plate 3 and glide 2 on through the drive rivet guide shoulder 60, and retains surface contact between the pivot plate 3, the glide 2 and the mount plate 1 through the pivot rivet retention head 62.

10. Drive Motor—provides rotational motion and torque to the torque wheel 4 to drive the mechanism. The motor is electric, and preferably rotates 360°, though a reversible motor can also be used.

11. Cover Screw—retains the cover 17 to the mount plate 1.

14. Magnet—provides a magnetic field to be sensed by the extended/retracted position sensor.

16. Hoop Strike—provides a latch retention surface for latching the occupant door.

17. Cover—covers all moveable part and retains the drive link 7 and the torque wheel 4 and maintains their contact.

18. Extended/Retracted Position Sensor—provides positional feedback by sensing the magnet 14 and opening or closing a circuit internal to itself that a cinching strike controller input can verify.

19. Sensor Retention Plate—provides for positive positional placement of the extended/retracted sensor 18, provides wire routing features, and location for a wire retaining zip tie 20 to be secured.

22. Vertical adjustment slots—on the mount plate 1 and allows for the cinching door mechanism to be adjusted vertically on a vehicle mounting location. (FIG. 2)

24. Torque wheel drive pin—mates with the drive link drive hole 50 to provide a place for an interface to the drive link land the torque wheel 4 (FIG. 23).

25. Magnet pocket—provides a place for the magnet 14 to be attached to the torque wheel 4 (FIG. 3).

26. Arcuate Drive Rivet Slot—in the mount plate 1 to provide sliding guide for the drive rivet 9 to pass through the mount plate 1, thus allowing the drive rivet head to be on the back side of the mount plate 1 so as to retain the pivot plate 3 and the glide 2 to the mount plate 1 (FIG. 3).

27. Retracted Sensor Position—senses the magnet 14 to tell the cinching door mechanism controller to stop motion that mechanism is retracted (FIG. 3).

28. Extended Sensor Position—senses the magnet 14 to tell the cinching door mechanism controller to stop motion that mechanism is extended (FIG. 3).

29. Longitudinal loading rivet—retains an upper part of the pivot plate 3 to the mount plate 1 when longitudinal load is placed on the strike device 16, 35. (FIGS. 5 and 7.)

30. Longitudinal loading slot—in the pivot plate 3 to provide a place for interface of the pivot plate 3 to the longitudinal loading rivet 29. (FIGS. 4 and 7).

31. Lower vertical adjustment slot—one of the slots 22 in the mount plate 1 to provide interface for the mounting fastener, and to allow for vertical adjustment of the cinching mechanism. (FIGS. 10 and 20.)

32. Upper vertical adjustment slot—one of the slots 22 in the mount plate 1, to provide interface for mounting the fastener, and to allow for vertical adjustment of the cinching mechanism. (FIGS. 10 and 20.)

36. Sensor retention plate pocket—U-shaped channel in the sensor retention plate 19 that accepts the extended sensor 28 and retracted sensor 27. (FIG. 27.)

38. Torque wheel bearing surface—provides a bearing surface for the torque wheel 4 to rest against the mount plate 1. (FIG. 25.)

39. Hoop strike latch retention surface—location where latching the device attaches the door to the cinching door mechanism. (FIG. 23.)

40. Pivot rivet mounting hole—pivot hole in the glide 2 that the glide pivots about, and maintains the relationship between the pivot plate 3 and the mount plate 1. (FIG. 25.)

43. Drive rivet retention slot—slot that controls the drive rivet 9 and allows for the drive rivet 9 to move the pivot plate 3 on the mount plate 1. (FIGS. 20 and 23.)

50. Drive link drive hole—receives the torque wheel drive pin 24 on the torque wheel 4 which allows the torque wheel 4 to drive the drive link 7. (FIG. 23.)

51. Sensor Face—Face of the extended/retracted sensor 18 that is oriented near the magnet 14 to sense the magnetic field. (FIG. 27.)

52. Torque wheel center drive—receives the motor drive shaft 53 to transfer rotation and torque to the torque wheel 4. (FIG. 25.)

53. Motor drive shaft—transfers rotation and torque from the drive motor 10 to the torque wheel 4 to drive the cinching door mechanism. (FIG. 23.)

54. Motor mounting holes—threaded holes that allow for the motor mount screw 13 to be threaded into the motor 10. (FIG. 23.)

55. Motor mounting holes—clearance hole in the mount plate 1 that allow for the motor mount screw 13 to pass through and align the drive motor 10 to the mount plate 1, also retains the drive motor 10 so it can pass rotation and torque to the torque wheel 4. (FIG. 23.)

56. Cover mounting holes—holes in the mount plate 1 that accept the cover screw 11, 12. (FIG. 23.)

59. Pivot rivet pivot shoulder—fits into the pivot rivet pivot hole 72 and allows rotational motion between the mount plate 1, the pivot plate 3, and the glide 2. (FIG. 23.)

60. Drive rivet guide shoulder—fits into drive rivet retention slot 43 to control movement of the pivot plate 3 and the glide 2, and passes through the drive rivet retention slot 43, the glide rivet drive hole 69, and the pivot plate drive hole 58. (FIG. 23.)

61. Drive rivet retention head—maintains contact with the mount plate surface to retain contact of the mount plate 1, the glide 2, and the pivot plate 3. (FIG. 23.)

62. Pivot rivet retention head—maintains contact with the mount plate surface to retain contact of the mount plate 1, the glide 2, and the pivot plate 3. (FIG. 23.)

64. Torque wheel pivot guide bore—accepts the torque wheel pivot guide shaft 37 to provide a bearing surface for side load of the torque wheel 4. (FIG. 27.)

65. Longitudinal load rivet mounting hole—accepts the longitudinal loading rivet mount shoulder 87 to fasten the longitudinal loading rivet 29 to the mount plate 1. (FIG. 23.)

67. Pivot rivet mounting hole—accepts the pivot rivet mount shoulder 85 and affixes the pivot rivet 8 to the pivot plate 3. (FIG. 23.)

72. Pivot rivet pivot hole—accepts the pivot rivet pivot shoulder 59 to allow rotational movement between the mount plate 1, the glide 2, and the pivot plate 3. (FIG. 23.)

73. Cover hold down surface—holds the torque wheel 4 and drive link 7 in place by maintaining contact with the drive pin hold down surface 80 and the drive link hold down surface 79. (FIG. 25.)

74. Hoop strike mounting hole—accepts the strike mount screw 15 to attach the hoop strike 6 to the pivot plate 3. (FIG. 25.)

75. Cover screw mounting holes—accepts the cover screws 11, 12 to attach the cover 17 to the mount plate 1. (FIG. 25.)

79. Drive link hold down surface—maintains contact with the cover hold down surface 73 to hold the drive link 7 in place. (FIG. 23.)

82. Motor mounting surface—provides a bearing clamp surface for the sensor retention plate 19 to mount to the motor 10. (FIG. 23.)

87. Longitudinal loading rivet mount shoulder—Fits into the longitudinal load rivet mounting hole 65 to retain the longitudinal loading rivet 29 to the mount plate 1. (FIG. 23.)

The invention has been shown and described above with the preferred embodiments, and it is understood that many modifications, substitutions, and additions may be made which are within the intended spirit and scope of the invention. From the foregoing, it can be seen that the present invention accomplishes at least all of its stated objectives.

The invention claimed is:

1. A power strike and rotary latch assembly for a vehicle door and door post, comprising:

a mount plate mountable on the door post;

a movable strike mountable on the mount plate for horizontal movement between extended and retracted positions relative to the door post;

a rotary latch mountable on the door to releasably engage the strike;

the mount plate being vertically adjustable relative to the rotary latch;

an electric motor connected to the strike to move the strike between the extended and retracted positions;

a switch in the rotary latch to send signals to actuate the motor when the rotary latch is fully engaged and disengaged from the strike;

whereby, when the rotary latch fully engages the strike, the motor is actuated to move the strike from the extended position to the retracted position to fully close the door; and whereby when the latch disengages from the strike, the motor is actuated to move the strike from the retracted position to the extended position to prepare for a next door closing;

the strike having an initial position which is adjustably mountable in a first inwardly position and a second and outwardly position relative to the mount plate.

2. The power strike and rotary latch assembly of claim 1 further comprising an adjustable linkage between the motor and the strike to allow for the inward and outward adjustment of the strike initial position.

3. The power strike and rotary latch assembly of claim 2 wherein the linkage comprises a drive link and a driven link adjustably coupled together.

4. The power strike and rotary latch assembly of claim 3 wherein the links have adjustable meshing teeth to provide the inward and outward adjustment of the strike initial position.

5. The power strike and rotary latch assembly of claim 1 wherein the motor is electrically powered independently of the rotary latch whereby the rotary latch is operable in the absence of power to open the door.

6. The power strike and rotary latch assembly of claim 1 wherein movement of the strike to the retracted position increases seal pressure between the door and the door post.

7. The combination of claim 1 wherein the strike is powered independently of the rotary latch.

8. The combination of claim 2 wherein the adjustable linkage includes a pair of adjustably connected link arms which can be coupled in extended and retracted positions to change an initial position of the pivot plate and the strike.

* * * * *